US010899101B2

(12) United States Patent
Graham et al.

(10) Patent No.: US 10,899,101 B2
(45) Date of Patent: Jan. 26, 2021

(54) MACHINE AND METHODS FOR ATTACHING RETAINING WEB TO CONTAINER BLANK

(71) Applicant: WestRock Shared Services, LLC, Norcross, GA (US)

(72) Inventors: Thomas Dean Graham, Winter Garden, FL (US); Amer Aganovic, Orlando, FL (US); Greg Gulik, Deland, FL (US)

(73) Assignee: WestRock Shared Services, LLC, Atlanta, GA (US)

( * ) Notice: Subject to any disclaimer, the term of this patent is extended or adjusted under 35 U.S.C. 154(b) by 146 days.

(21) Appl. No.: 15/949,973

(22) Filed: Apr. 10, 2018

(65) Prior Publication Data

US 2019/0308382 A1 Oct. 10, 2019

(51) Int. Cl.
*B31B 50/04* (2017.01)
*B31B 50/62* (2017.01)
(Continued)

(52) U.S. Cl.
CPC ..... *B31B 50/044* (2017.08); *B31B 50/06* (2017.08); *B31B 50/07* (2017.08); *B31B 50/16* (2017.08);
(Continued)

(58) Field of Classification Search
CPC ..... B31B 50/044; B31B 50/06; B31B 50/16; B31B 50/07; B31B 50/624; B31B 2110/35; B31B 2120/302
(Continued)

(56) References Cited

U.S. PATENT DOCUMENTS 2,111,157 A * 3/1938 Stokes ..... B31B 70/00 493/110
2,284,604 A 5/1942 Brooks
(Continued)

FOREIGN PATENT DOCUMENTS

DE 9207356 U1 8/1992
FR 2506722 A1 12/1982
(Continued)

OTHER PUBLICATIONS

International Search Report for PCT/US2016/051502, dated Feb. 10, 2017, 7 pages.
(Continued)

*Primary Examiner* — Thanh K Truong
*Assistant Examiner* — Katie L Gerth
(74) *Attorney, Agent, or Firm* — John Swingle

(57) ABSTRACT

A machine including a deck, a first platform, a second platform, a first web transfer assembly, and a second web transfer assembly is provided. The deck and first and second platforms are coupled to a frame. The first web transfer assembly extends from a first end to a second end and includes a first pick-up assembly moveable between the first end, proximate the first platform, and the second end, proximate the deck. The second web transfer assembly extends from a third end to a fourth end and includes a second pick-up assembly moveable between the third end, proximate the second platform, and the fourth end, proximate the deck. The first web transfer assembly and the second web transfer assembly are operationally offset when moving between the first and second end and the third and fourth ends, respectively.

12 Claims, 15 Drawing Sheets

(51) Int. Cl.

| | |
|---|---|
| ***B31B 50/07*** | (2017.01) |
| ***B31B 50/16*** | (2017.01) |
| ***B31B 50/06*** | (2017.01) |
| ***B31B 120/30*** | (2017.01) |
| ***B31B 110/35*** | (2017.01) |

(52) U.S. Cl.
CPC ..... *B31B 50/624* (2017.08); *B31B 2110/35* (2017.08); *B31B 2120/302* (2017.08)

(58) Field of Classification Search
USPC ..... 493/56, 907, 93; 53/64, 449, 175
See application file for complete search history.

(56) References Cited

U.S. PATENT DOCUMENTS

| | | | | | |
|---|---|---|---|---|---|
| 2,295,461 | A * | 9/1942 | Federwitz | B31B 70/00 | 493/162 |
| 2,502,117 | A | 3/1950 | Helmer | | |
| 2,837,261 | A | 6/1958 | Stenger | | |
| 2,944,715 | A | 7/1960 | Vergobbi | | |
| 3,289,384 | A | 12/1966 | Kraut | | |
| 3,367,823 | A * | 2/1968 | Clausen | B27D 1/04 | 156/281 |
| 3,442,372 | A | 5/1969 | Carmichael et al. | | |
| 3,669,337 | A | 6/1972 | Struble | | |
| 3,877,630 | A | 4/1975 | Silver | | |
| 3,964,953 | A * | 6/1976 | Mitchard | B31B 50/00 | 156/300 |
| 4,043,442 | A * | 8/1977 | Greenwell | B65B 35/44 | 198/418.1 |
| 4,066,008 | A | 1/1978 | Arvanigian | | |
| 4,186,868 | A | 2/1980 | Coleman | | |
| 4,242,949 | A | 1/1981 | Auckenthaler | | |
| 4,328,896 | A | 5/1982 | Behne | | |
| 4,608,038 | A * | 8/1986 | Virta | B31B 50/00 | 493/110 |
| 4,650,448 | A * | 3/1987 | Urso | B31B 50/00 | 493/110 |
| 4,757,900 | A | 7/1988 | Misset et al. | | |
| 4,932,930 | A | 6/1990 | Coalier et al. | | |
| 5,035,683 | A | 7/1991 | Takeda et al. | | |
| 5,086,925 | A | 2/1992 | Coalier et al. | | |
| 5,147,271 | A | 9/1992 | Bacques et al. | | |
| 5,160,307 | A | 11/1992 | Bacques et al. | | |
| 5,224,919 | A * | 7/1993 | Walsh | B31B 50/00 | 493/110 |
| 5,256,129 | A | 10/1993 | Jaen | | |
| 5,333,721 | A * | 8/1994 | Stevie | B65B 5/061 | 198/418.6 |
| 5,393,291 | A | 2/1995 | Wingerter | | |
| 5,400,955 | A | 3/1995 | Coalier et al. | | |
| 5,501,062 | A * | 3/1996 | Ambergen | B31B 50/00 | 206/597 |
| 5,566,827 | A | 10/1996 | Janhonen | | |
| 5,624,368 | A | 4/1997 | Cromwell | | |
| 5,656,006 | A | 8/1997 | East et al. | | |
| 6,058,679 | A * | 5/2000 | Ziegler | B65B 5/024 | 53/447 |
| 6,106,450 | A | 8/2000 | Brittain | | |
| 6,319,183 | B1 | 11/2001 | Ballos, III | | |
| 6,955,518 | B1 | 10/2005 | Hagel | | |
| 7,322,171 | B2 | 1/2008 | Bonnain et al. | | |
| 7,445,589 | B2 | 11/2008 | Jaen | | |
| 7,857,743 | B2 | 12/2010 | Barner | | |
| 8,105,223 | B2 | 1/2012 | Graham et al. | | |
| 8,485,420 | B2 | 7/2013 | Barner | | |
| 9,889,962 | B2 | 2/2018 | McDonald et al. | | |
| 2002/0134052 | A1 | 9/2002 | Bernardo | | |
| 2003/0119640 | A1 | 6/2003 | Jaen | | |
| 2003/0197051 | A1 | 10/2003 | Muise | | |
| 2005/0079965 | A1 | 4/2005 | Moshier et al. | | |
| 2005/0159283 | A1 | 7/2005 | Jaen | | |
| 2007/0037682 | A1 | 2/2007 | Scholtes et al. | | |
| 2007/0191201 | A1 * | 8/2007 | Reuteler | B65B 7/20 | 493/162 |
| 2008/0039308 | A1 | 2/2008 | Herrin | | |
| 2008/0067225 | A1 | 3/2008 | Moore | | |
| 2008/0078819 | A1 | 4/2008 | Strong et al. | | |
| 2008/0120947 | A1 | 5/2008 | Oldsen et al. | | |
| 2008/0142407 | A1 | 6/2008 | Moore | | |
| 2008/0210591 | A1 | 9/2008 | Cheich | | |
| 2008/0250759 | A1 | 10/2008 | Cash | | |
| 2009/0098991 | A1 | 4/2009 | Graham et al. | | |
| 2010/0219232 | A1 | 9/2010 | Smith | | |
| 2011/0053746 | A1 * | 3/2011 | Desertot | B31D 1/005 | 493/102 |
| 2011/0065559 | A1 | 3/2011 | Atoui et al. | | |
| 2011/0281705 | A1 | 11/2011 | Aganovic | | |
| 2012/0100976 | A1 | 4/2012 | Graham et al. | | |
| 2012/0267425 | A1 | 10/2012 | Whiteside et al. | | |
| 2014/0371045 | A1 * | 12/2014 | Bruneau | B31B 50/74 | 493/52 |
| 2016/0083124 | A1 * | 3/2016 | Last | B65B 5/06 | 53/410 |
| 2016/0280407 | A1 | 9/2016 | Lindt et al. | | |
| 2016/0297600 | A1 | 10/2016 | McDonald et al. | | |
| 2017/0080666 | A1 | 3/2017 | Graham et al. | | |
| 2017/0080667 | A1 * | 3/2017 | Graham | B31B 50/62 | |
| 2017/0320608 | A1 | 11/2017 | Schuster | | |

FOREIGN PATENT DOCUMENTS

| | | | |
|---|---|---|---|
| FR | 2828170 | A1 | 2/2003 |
| FR | 2853885 | A1 | 10/2004 |
| GB | 2343885 | A | 5/2000 |
| GB | 2437725 | A | 11/2007 |
| GB | 2474068 | A | 4/2011 |
| JP | S6186309 | A | 5/1986 |
| WO | 2011042707 | A1 | 4/2011 |

OTHER PUBLICATIONS

Office Action, dated May 28, 2015, for co-pending MX Patent Application No. MX/a/2010/012003, 3 pages. No English translation available.

Mekatronik Gruppe; https://mekatronikgruppe6.files.wordpress.com/2014/04/h-bot1.png.

* cited by examiner

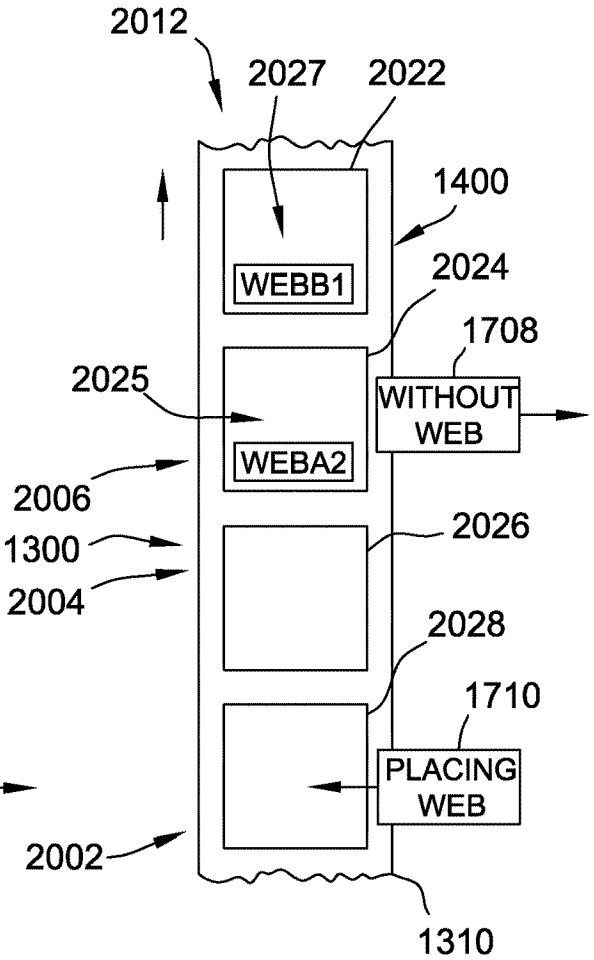
FIG. 13C
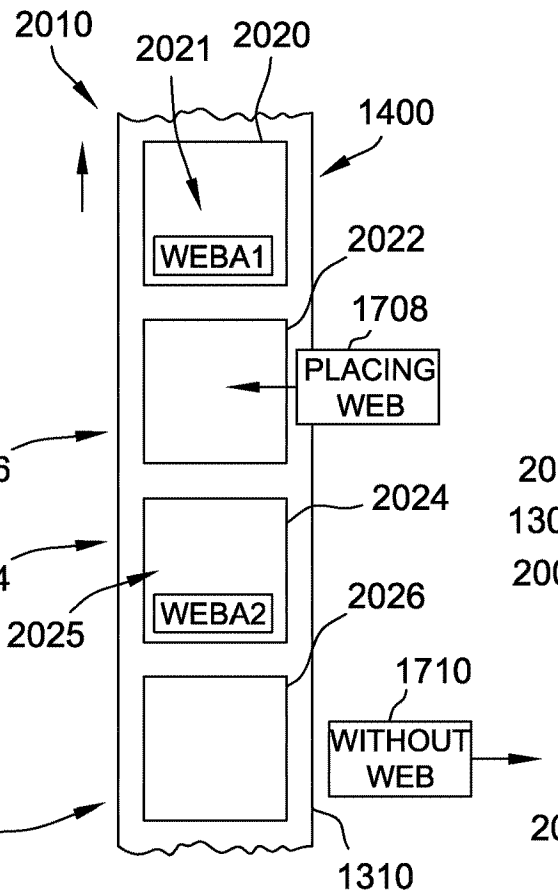
FIG. 13B
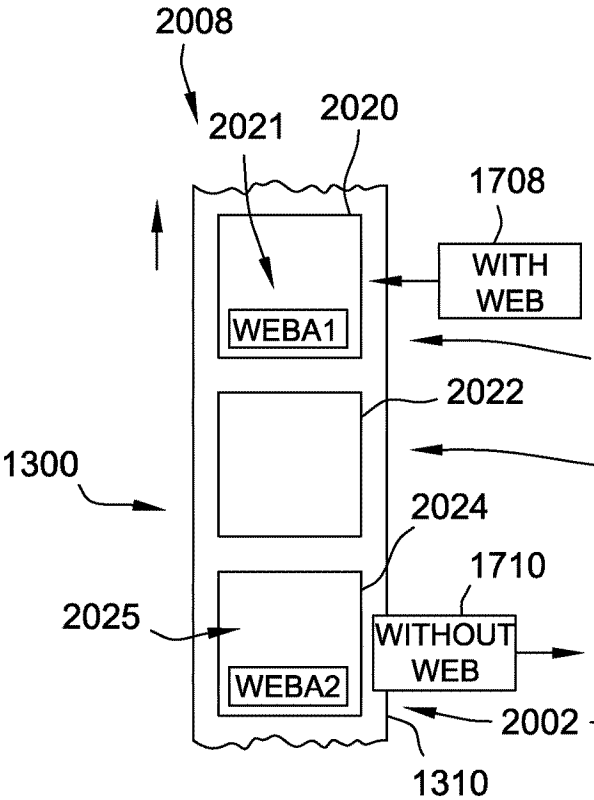
FIG. 13A
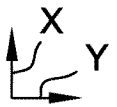

MACHINE AND METHODS FOR ATTACHING RETAINING WEB TO CONTAINER BLANK

BACKGROUND

This disclosure relates generally to a machine for forming a blank assembly, and more specifically to a machine and methods for forming a blank assembly including a retaining web coupled to a blank.

E-commerce is growing to represent a substantial part of the global economy. As e-commerce grows, the need for shipping packages containing goods also increases. Containers for shipping goods are typically made in standard or predetermined sizes, and then are purchased and used to ship the goods therein. In many cases, the goods to be shipped are smaller than the container in which they are shipped. To avoid damage to the goods from being jostled within the container, buffer or filler material may be placed in the container (e.g., packing peanuts, bubble wrap, etc.). This buffer material can be expensive, wasteful, and/or harmful to the environment.

Therefore, there is a need for containers that are able to securely retain the products therein, or to conform an interior thereof to the products to be shipped. In addition, there is a need for a machine that can quickly make blank assemblies to be formed into such containers.

BRIEF DESCRIPTION

In one embodiment, a machine for forming a blank assembly including a first blank and a first retaining web coupled to the first blank and a second blank and a second retaining web coupled to the second blank is provided. The machine comprises a deck, a first web transfer assembly, and a second web transfer assembly. The deck is coupled to a frame, and the first and second blanks are positioned on the deck. The first web transfer assembly extends from a first end to a second end and includes a first pick-up assembly moveable between the first end and the second end and is configured to pick up the first retaining web proximate the first end and deposit the first web proximate the second end in an at least partially overlying relationship with the first blank positioned on the deck. The second first web transfer assembly extends from a third end to a fourth end, includes a second pick-up assembly moveable between the third end and the fourth end, and is configured to pick up the second retaining web proximate the third end and deposit the second web proximate the fourth end in an at least partially overlying relationship with the second blank positioned on the deck. The first web transfer assembly and the second web transfer assembly are operationally offset from one another when transferring the first retaining web and transferring the second retaining web.

In another embodiment, a method for forming a plurality of blank assemblies using a machine is provided. The plurality of blank assemblies include a first blank assembly including a first blank and a first retaining web coupled to the first blank and a second blank assembly including a second blank and a second retaining web coupled to the second blank. The method comprises positioning the first and second blanks on a deck coupled to a frame of the machine, transferring the first retaining web, depositing the first retaining web, transferring the second retaining web, and depositing the second retaining web. The first blank is at a first position on the deck and the second blank is at a second position on the deck. The first retaining web is transferred from proximate a first end of a first web transfer assembly to proximate a second end of the first web transfer assembly using a first pick-up assembly of the machine. The first retaining web is deposited proximate the second end of the first web transfer assembly in an at least partially overlying relationship with the first blank positioned on the deck. The second retaining web is transferred from proximate a third end of a second web transfer assembly to proximate a fourth end of the second web transfer assembly using a second pick-up assembly of the machine, operationally offset from the transferring of the first retaining web. The second retaining web is deposited proximate the fourth end of the second web transfer assembly in an at least partially overlying relationship with the second blank positioned on the deck.

BRIEF DESCRIPTION OF THE DRAWINGS

FIGS. 13A-13E depict a simplified process of coupling the retaining webs to the blanks.

DETAILED DESCRIPTION

The machine described herein for forming a blank assembly including a retaining web coupled to the blank, overcomes the limitations of known machines for forming blank assemblies. The machine described herein includes a first web transfer assembly and a second web transfer assembly configured to pick and place a cut section of a first and a second retaining web in an at least partially overlying relationship with the respective first and second blanks positioned on a machine deck.

Figure 1:
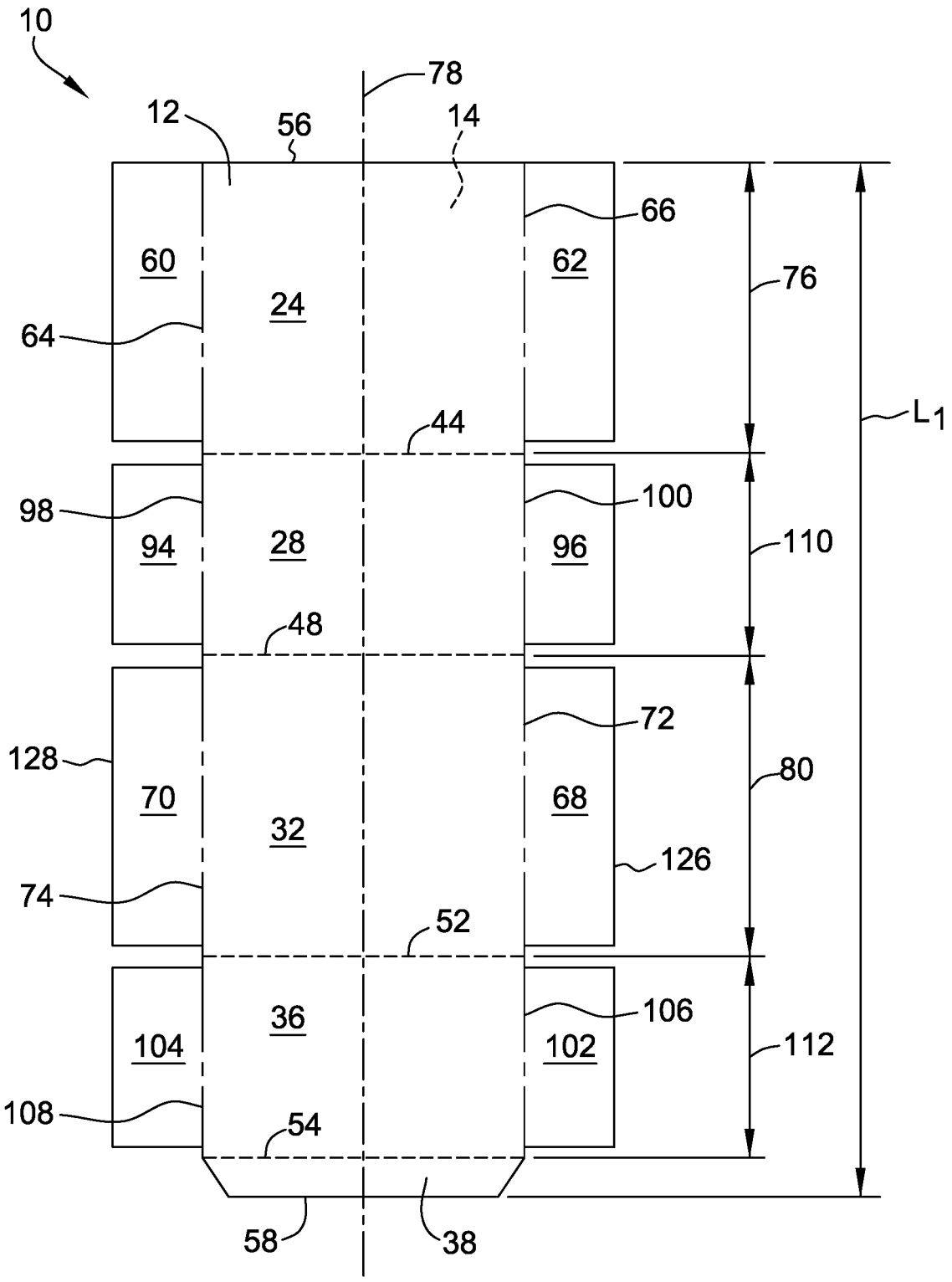
FIG. 1 is a top plan view of an example embodiment of a blank of sheet material.

FIG. 1 illustrates a top plan view of an example embodiment of a substantially flat blank 10 of sheet material. As shown in FIG. 1, blank 10 has an interior surface 12 and an exterior surface 14. In certain embodiments, portions of exterior surface 14 and/or interior surface 12 of blank 10 include printed graphics, such as advertising and/or promotional materials.

Blank 10 extends from a leading edge 126 to a trailing edge 128 and includes a series of aligned side panels connected together by a plurality of preformed, generally parallel, fold lines defined generally perpendicular to leading edge 126 and trailing edge 128. Specifically, the side panels include a first side panel 24, a first end panel 28 (also referred to as a rear end panel 28), a second side panel 32, a second end panel 36 (also referred to as a front end panel 36), and a glue panel 38 connected in series along a plurality of parallel fold lines 44, 48, 52, and 54. First side panel 24 extends from a first free edge 56 to fold line 44, first end panel 28 extends from first side panel 24 along fold line 44, second side panel 32 extends from first end panel 28 along fold line 48, second end panel 36 extends from second side panel 32 along fold line 52, and glue panel 38 extends from second end panel 36 along fold line 54 to a second free edge 58. Blank 10 has a length $L_1$ between first free edge 56 and second free edge 58.

A first top side panel 60 and a first bottom side panel 62 extend from opposing edges of first side panel 24. More specifically, first top side panel 60 and first bottom side panel 62 extend from first side panel 24 along a pair of opposing preformed, generally parallel, fold lines 64 and 66, respectively. Similarly, a second bottom side panel 68 and a second top side panel 70 extend from opposing edges of second side panel 32. More specifically, second bottom side panel 68 and second top side panel 70 extend from second side panel 32 along a pair of opposing preformed, generally parallel, fold lines 72 and 74, respectively. Fold lines 64, 66, 72, and 74 are generally parallel to each other and generally perpendicular to fold lines 40, 44, 48, and 52. First side panel 24 has a width 76 taken along a central horizontal axis 78 of blank 10 that is substantially equal to width 80 taken along central horizontal axis 78 of second side panel 32.

As shown in FIG. 1, a first top end panel 94 and a first bottom end panel 96 extend from opposing edges of first end panel 28. More specifically, first top end panel 94 and first bottom end panel 96 extend from first end panel 28 along a pair of opposing preformed, generally parallel, fold lines 98 and 100, respectively. Similarly, a second bottom end panel 102 and a second top end panel 104 extend from opposing edges of second end panel 36. More specifically, second bottom end panel 102 and second top end panel 104 extend from second end panel 36 along a pair of opposing preformed, generally parallel, fold lines 106 and 108, respectively. Fold lines 98, 100, 106, and 108 are generally parallel to each other and generally perpendicular to fold lines 44, 48, 52, and 54. First end panel 28 has a width 110 taken along central horizontal axis 78 of blank 10 that is substantially equal to width 112 of second end panel 36, also taken along central horizontal axis 78.

Of course, blanks having shapes, sizes, and configurations different from blank 10 described and illustrated herein may be used in machine 1000 (shown in FIG. 4) without departing from the scope of the present invention. For example, blank 10 is shown as a four-sided container, but could be a six-sided container, an eight-sided container, or an N-sided container without departing from the scope of this disclosure.

Figure 2:
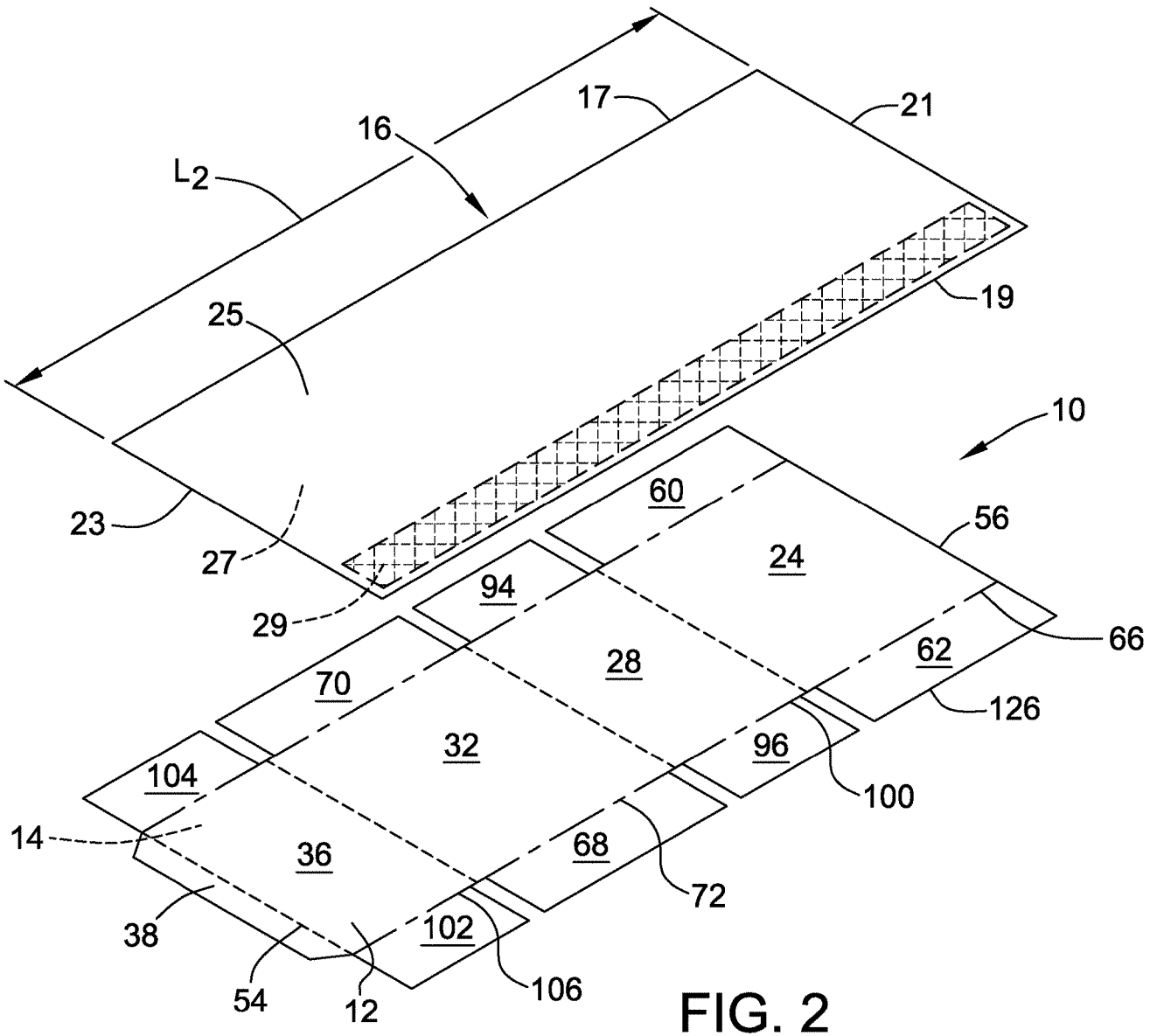
FIG. 2 is a perspective view of an example embodiment of the blank of sheet material shown in FIG. 1 along with the retaining web.

FIG. 2 is a perspective view of blank 10 in relationship to a retaining web 16. In the example embodiment, web 16 is a unitary sheet. In alternative embodiments, web 16 is formed from multiple sheets. In the example embodiment, web 16 is formed from a liner paper material. In certain embodiments, web 16 is formed from one or more materials having substantially identical recycling characteristics to a material from which blank 10 is formed. In alternative embodiments, web 16 is formed from any suitable material that enables blank assembly 130 to function as described herein.

Web 16 extends from a first side free edge 21 to a second side free edge 23. A length $L_2$ of web 16 is defined between first side free edge 21 and second side free edge 23. In the example embodiment, $L_2$ is less than $L_1$ of blank 10 (shown in FIG. 1). In alternative embodiments, $L_2$ is other than less than $L_1$. Web 16 also extends from a top free edge 17 to a bottom free edge 19. Top free edge 17 and bottom free edge 19 are typically perpendicular to both first side free edge 21 and second side free edge 23. Web 16 also includes a top surface 25 and an opposite bottom surface 27. In some embodiments, web 16 has a thickness of 10 mils (0.254 millimeters) (e.g., the distance between top surface 25 and bottom surface 27).

In the example embodiment, web 16 includes a co-adhesive material applied to at least one side of top surface 25 and bottom surface 27 of web 16. With the co-adhesive applied to web 16, at least a portion of web 16 is able to securely adhere to another portion of web 16 having the co-adhesive applied thereto, such that those portions will stick together. In some embodiments, top surface 25 is coated in or otherwise includes the co-adhesive material, which is an adhesive that adheres only to surfaces coated in or otherwise including the same or similar co-adhesive material. Thus, in such embodiments, top surface 25 will adhere to itself and only itself (i.e., not to bottom surface 27) when a first portion of top surface 25 is brought into contact with a second portion of top surface 25. In alternative embodiments, bottom surface 27 is coated in or otherwise includes the co-adhesive material. In still further alternative embodiments, both top surface 25 and bottom surface 27 are coated in or otherwise include the co-adhesive material.

As will be described below in more detail with reference to FIGS. 2 and 3, web 16 is intended to be attached to blank 10. In some embodiments, web 16 is adhered to blank 10 by first applying adhesive to a coupling region 29 on bottom surface 27 of web 16. Bottom surface 27 of web 16 is then placed on blank 10 (e.g., on interior surface 12 including panels 24, 28, 32, and 36) and pressure is applied to top surface 25 of web 16 and exterior 14 of blank 10 in the areas above and below, respectively, coupling region 29 such that web 16 is adhered to blank 10 to form a blank assembly 130 (shown in FIG. 3).

Figure 3:
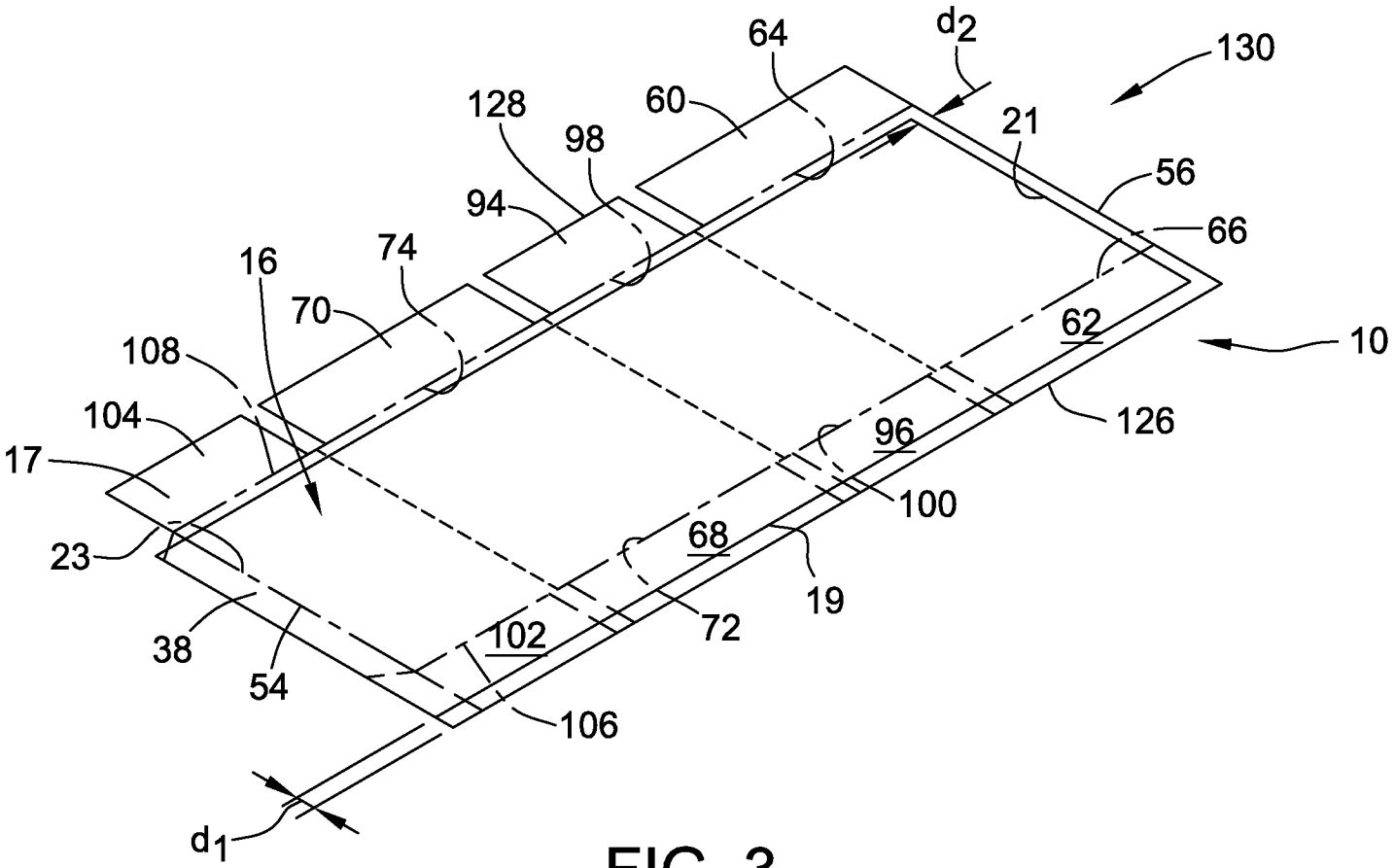
FIG. 3 is a perspective view of an example embodiment of a blank assembly that includes the blank shown in FIG. 1 and the retaining web shown in FIG. 2.

FIG. 3 illustrates a perspective view of blank assembly 130 which includes blank 10 with attached web 16. As will be described below in more detail with reference to FIGS. 2 and 3, web 16 is positioned relative to one or more features of blank 10.

In some embodiments, web 16 is attached with bottom free edge 19 positioned across bottom side panels 62 and 68 and bottom end panels 96 and 102 and top free edge 17 positioned across side panels 24, 28, 32, and 36, such that web 16 spans across fold lines 66, 100, 72, and 106. For example, in the embodiment illustrated in FIG. 3, web 16 is positioned across side panels 24, 28, 32, and 36 and across fold lines 66, 100, 72, and 106 such that there is substantial overlap of web 16 with bottom side panels 62 and 68 and bottom end panels 96 and 102. In alternative embodiments, web 16 is attached with bottom free edge 19 substantially aligned with fold lines 66, 100, 72, and 106. In other alternative embodiments, web 16 does not cross fold lines 66, 100, 72, and 106. In the example embodiment, a first predetermined offset distance $d_1$ is defined between bottom free edge 19 of web 16 and leading edge 126 of blank 10.

In some embodiments, including the embodiment illustrated in FIG. 3, web 16 is attached to blank 10 such that first side free edge 21 is offset from first free edge 56 of blank 10 by a second predetermined offset distance $d_2$, such that interior surface 12 of blank 10 is not covered by web 16 adjacent first free edge 56. In alternative embodiments, first side free edge 21 is one of substantially aligned with first free edge 56 and offset from first free edge 56 such that web 16 overhangs first free edge 56. In some embodiments, including the embodiment illustrated in FIG. 3, web 16 is attached to blank 10 such that second side free edge 23 covers glue panel 38 of blank 10. In alternative embodiments, second side free edge 23 is lined up with fold line 54 of blank 10. In other alternative embodiments, second side free edge 23 is positioned such that it does not reach fold line 54.

In some embodiments, including the embodiment illustrated in FIG. 3, top free edge 17 of web 16 is substantially aligned with fold lines 64, 98, 74, and 108 of blank 10 such that web 16 does not overlap top side panels 60 and 70 and top end panels 94 and 104. In other words, web 16 does not cover top panels 60, 70, 94, and 104. In an alternative embodiment, web 16 is attached to blank 10 and sized such that top free edge 17 of web 16 is positioned between fold lines 64, 98, 74, and 108 and trailing edge 128. In an alternative embodiment, web 16 completely covers top panels 60, 70, 94, and 104. In a further alternative embodiment, top free edge 17 of web 16 is spaced a distance from fold lines 64, 98, 74, and 108 such that web 16 only overlaps a portion of side panels 24, 28, 32, and 36.

Figure 4:
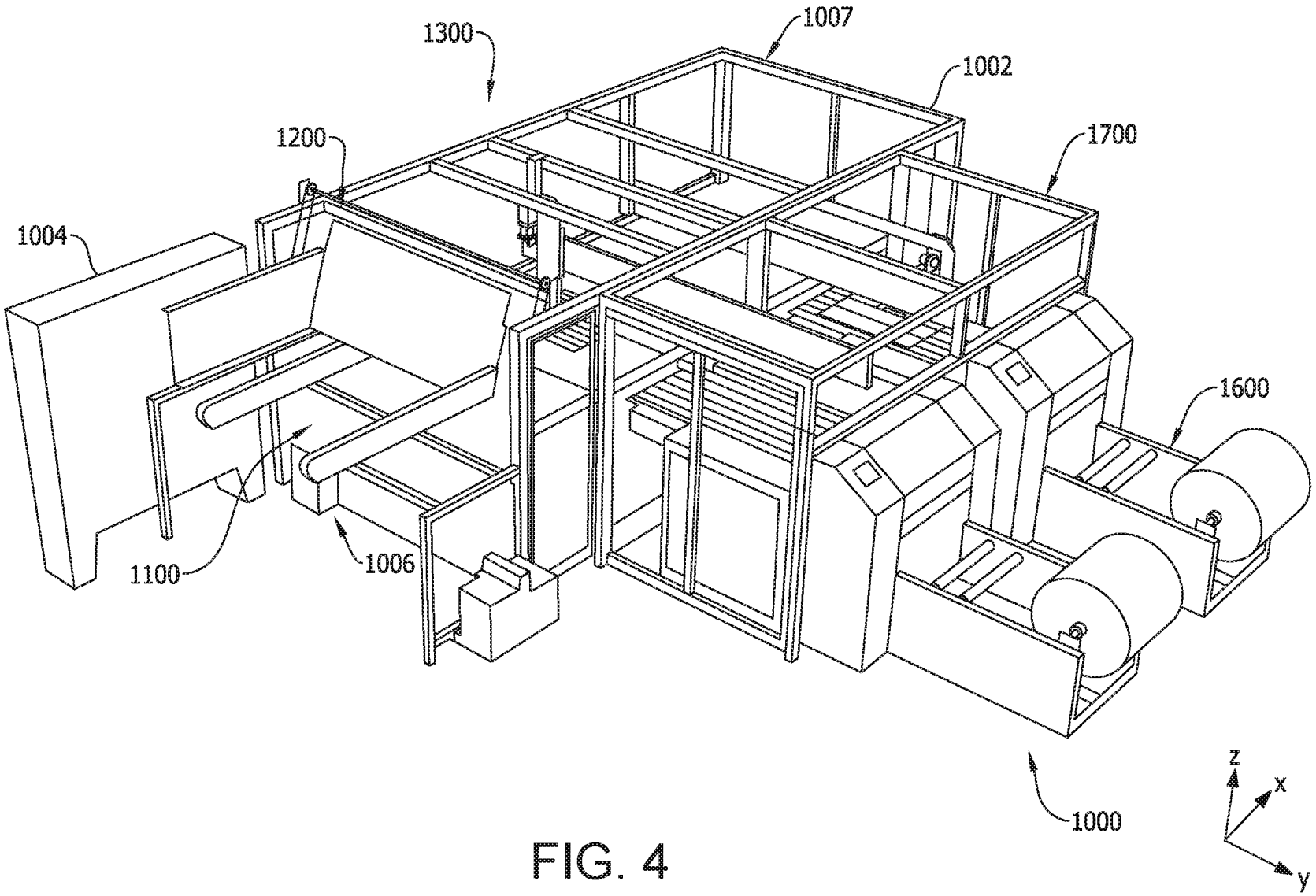
FIG. 4 is a right perspective view of an example embodiment of a machine that may be used to form a blank assembly having a retaining web as shown in FIG. 3.
Figure 5:
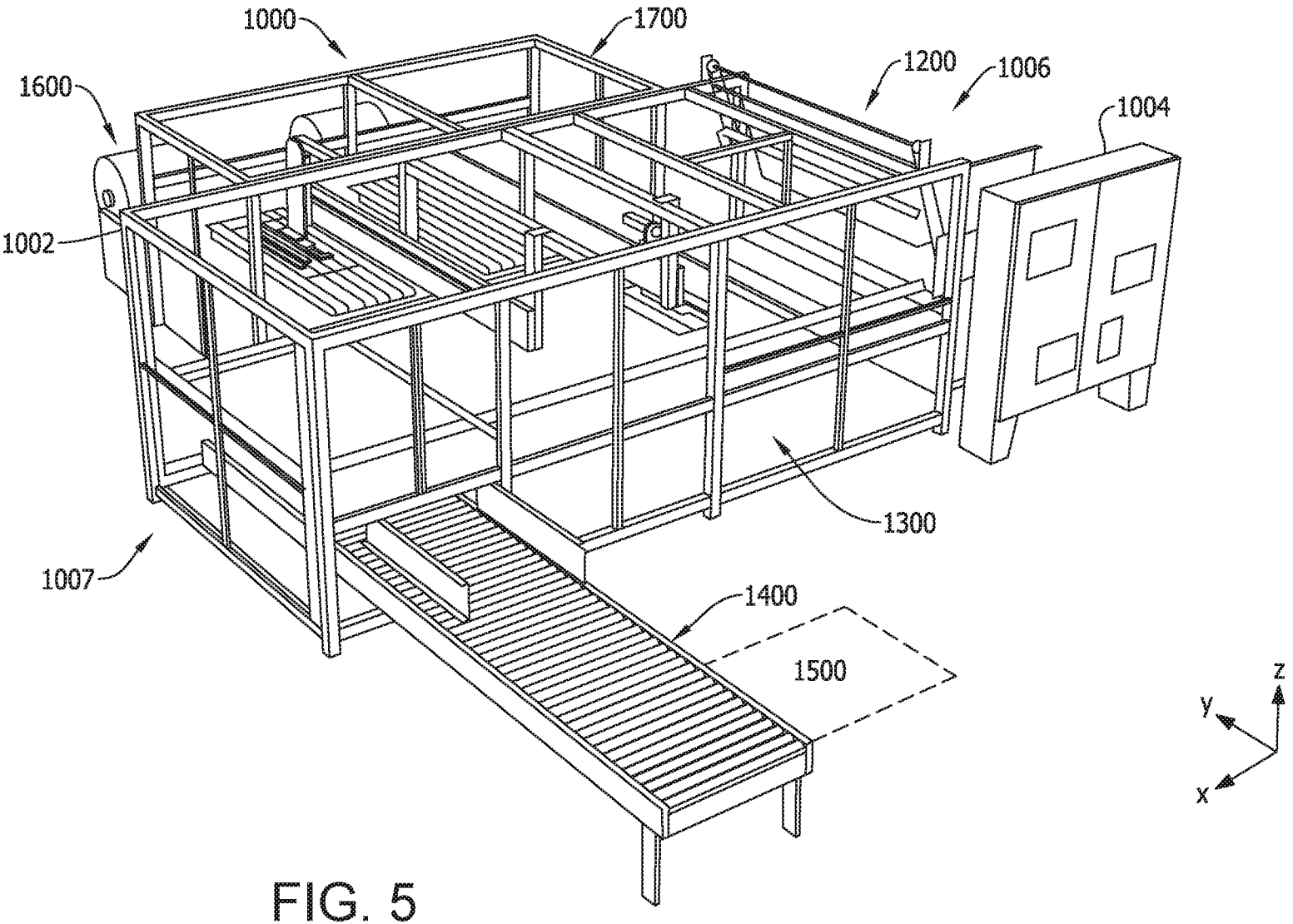
FIG. 5 is a left perspective view of the example embodiment of the machine shown in FIG. 4.

FIG. 4 is a right schematic perspective view of an example machine 1000 for forming a blank assembly having a retaining web, such as blank assembly 130 (shown in FIG. 3), from a blank, such as blank 10 (shown in FIGS. 1-3) and a web, such as web 16 (shown in FIGS. 2 and 3). While machine 1000 will be discussed hereafter with reference to forming blank assembly 130 from blank 10 and web 16, machine 1000 may be used to form a blank assembly having any size, shape, and/or configuration from a blank and web each having any suitable size, shape, and/or configuration without departing from the scope of the present disclosure. FIG. 5 is a left schematic perspective view of the example machine 1000 shown in FIG. 4.

With reference to FIGS. 1-5, machine 1000 includes a feed section 1100, a blank transfer section 1200, an indexing section 1300, an outfeed section 1400, a web separator 1600, and a web transfer section 1700 each positioned with respect to, coupled to, and/or otherwise associated with a frame 1002. A control system 1004 is coupled in operative control communication with certain components of machine 1000. In the example embodiment, actuators are used to at least one of transfer blanks 10 and webs 16 within machine 1000 and couple blanks 10 to webs 16 to form blank assembly 130, as will be described in more detail below. The actuators may include, for example, jacks, mechanical linkages, servomechanisms, other suitable mechanical or electronic actuators, or any suitable combination thereof. As used herein, the terms "servo-actuated" and "servo-controlled" refers to any component and/or device having its movement controlled by a servomechanism. As described herein, a control system is any suitable system that controls the movement and/or timing of at least one actuator or other mechanically or electronically driven component of machine 1000.

In certain embodiments, such as, but not limited to, embodiments where at least one servomechanism is used, control system 1004 may enable an operator to change recipes or protocols by making a selection on a user interface. The recipes are computer instructions for controlling the machine to form different size boxes, different types of boxes, and/or control the output of the formed blank assemblies. The different recipes control the speed, timing, force applied, and/or other motion characteristics of the different forming components of the machine including how the components move relative to one another.

In the example embodiment, feed section 1100 is positioned at an upstream end 1006 of machine 1000 with respect to a blank loading direction indicated by an arrow X. Blank transfer section 1200 is positioned downstream from feed section 1100 and indexing section 1300 is positioned downstream from blank transfer section 1200, both with respect to blank loading direction X. Outfeed section 1400 is positioned downstream from indexing section 1300 with respect to direction X, at a downstream end 1007 of machine 1000. Web transfer section 1700 is located downstream of indexing section 1300, and web separator 1600 is located upstream from web transfer section 1700, with respect to a direction indicated by an arrow Y, which is generally transverse to blank loading direction X. Blank loading direction X and transverse direction Y define a generally horizontal plane, with a vertical direction Z defined perpendicular to the horizontal plane. In alternative embodiments, each of feed section 1100, blank transfer section 1200, indexing section 1300, outfeed section 1400, web separator 1600, and web transfer section 1700 is positioned with respect to others of feed section 1100, blank transfer section 1200, indexing section 1300, outfeed section 1400, web separator 1600, and web transfer section 1700 in any suitable location.

In the example embodiment, a product load section 1500 is positioned with respect to machine 1000 downstream from outfeed section 1400 with respect to transverse direction X. In alternative embodiments, product load section 1500 is positioned with respect to machine 1000 in any suitable location. For example, but not by way of limitation, product load section 1500 is located at one or more locations remote to machine 1000.

Figure 6:
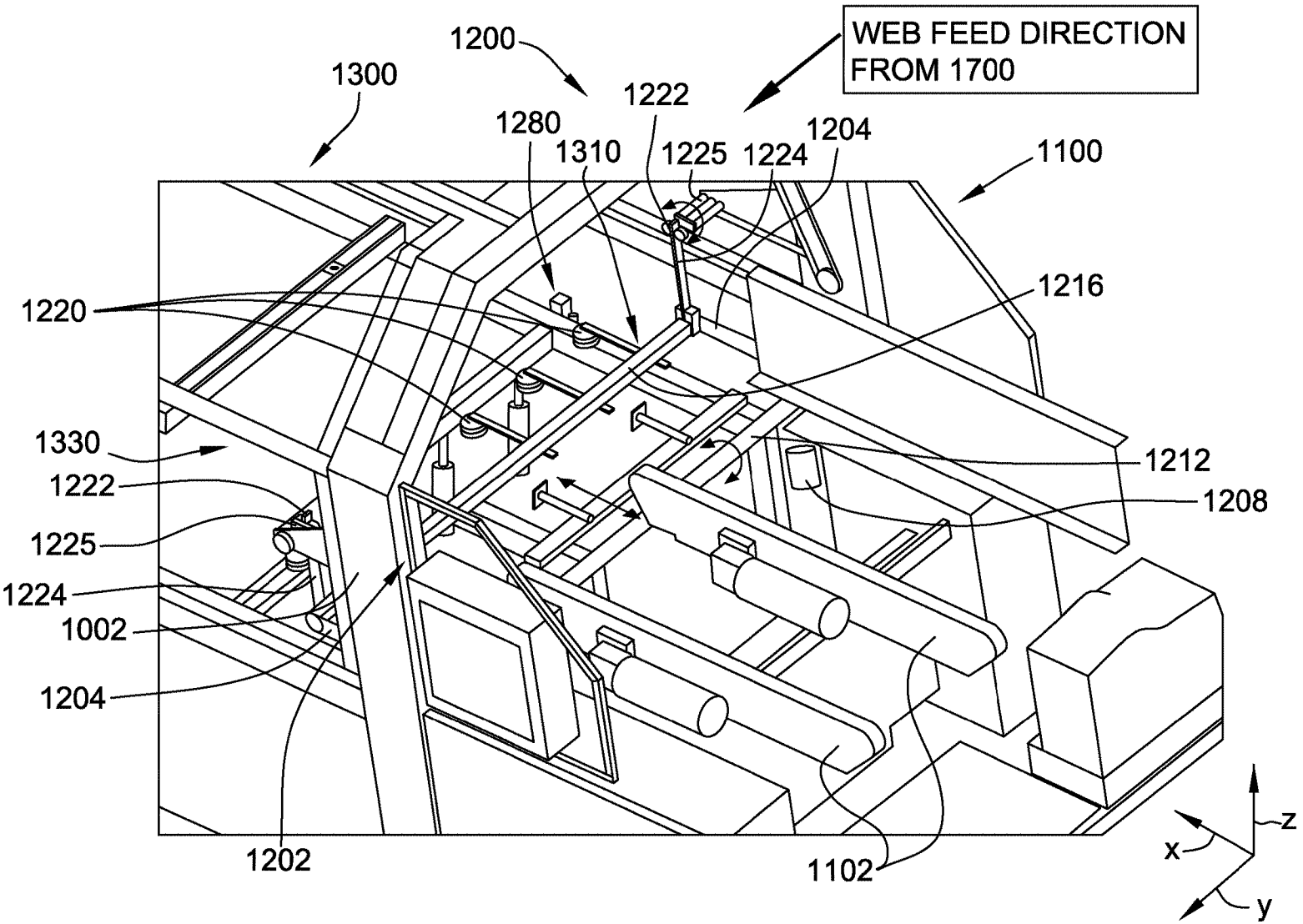
FIG. 6 is a perspective view of an example feed section and example transfer section of the machine shown in FIGS. 4 and 5.

FIG. 6 is a schematic perspective view of an example embodiment of feed section 1100 and an example embodiment of blank transfer section 1200 of machine 1000. Feed section 1100 is configured to receive a plurality of blanks 10. In the example embodiment, feed section 1100 is a magazine feed section that includes a plurality of powered drives 1102. For example, each magazine drive 1102 is a belt conveyor. Magazine drives 1102 are configured to move first blanks 10 towards blank transfer section 1200. Additionally or alternatively, feed section 1100 includes any suitable structure that enables feed section 1100 to function as described herein. In the example embodiment, blanks 10 (shown in FIG. 1) are oriented generally in the vertical direction Z within feed section 1100, such that leading edge 126 of each blank 10 is positioned against drives 1102 and interior surface 12 of each blank faces transfer section 1200. In alternative embodiments, feed section 1100 is configured to present blanks 10 in another suitable orientation, such as, but not limited to, a generally horizontal configuration. In the example embodiment, feed section 1100 includes at least one alignment device (not shown) such as, but not limited to, a stack presser, to facilitate justifying and/or aligning blanks 10 in the magazine of feed section 1100.

In the example embodiment, blank transfer section 1200 includes a blank transfer assembly 1202 coupled to, or otherwise associated with, frame 1002 proximate feed section 1100. Blank transfer assembly 1202 is configured to extract one of blanks 10 from feed section 1100 and position the extracted blank 10 on a deck 1310, as described further herein with respect to FIG. 7. More specifically, blank transfer assembly 1202 is configured to position each extracted blank 10 on deck 1310 such that leading edge 126 of blank 10 is aligned substantially at a predetermined location along deck 1310 with respect to the X direction, and first free edge 56 is aligned substantially at a predetermined location along deck 1310 with respect to the Y direction.

In the example embodiment, first blank transfer assembly 1202 includes a drive shaft 1212 supported and aligned generally parallel to the transverse Y direction by at least one bearing (not shown). Drive shaft 1212 is operably coupled to a suitable actuator 1208 for bi-directional rotation about its shaft axis. For example, actuator 1208 includes at least one of a hydraulic jack, an air cylinder, a mechanical linkage, a servomechanism, and another suitable mechanical or electronic actuator. A pair of arms 1204 extend from opposite ends of drive shaft 1212, and rotate with drive shaft 1212. A pick-up bar 1216 is aligned parallel to drive shaft 1212, and is coupled between arms 1204 for free rotation about its bar axis. A plurality of vacuum suction cups 1220 are fixedly coupled to pick-up bar 1216. Each suction cup 1220 is operably coupled to a respective independent vacuum generator (not shown) for selectively providing suction to selectively attach suction cups 1220 to blank 10 presented in feed section 1100. In alternative embodiments, at least some suction cups 1220 are coupled to a common vacuum generator. Further in the example embodiment, a respective guide rod 1224 is fixedly coupled to each end of pick-up bar 1216. Each guide rod 1224 is slidably coupled through a respective pair of rollers 1222 coupled to a respective pivot block 1225. In turn, each pivot block 1225 is pivotably coupled to frame 1002 for rotation about an axis parallel to drive shaft 1212. In alternative embodiments, first blank transfer assembly 1202 includes any suitable additional or alternative components that enable first blank transfer assembly 1202 to function as described herein.

In operation, first blank transfer assembly 1202 is controlled, commanded, and/or instructed to position suction cups 1220 to facilitate extracting blank 10 from feed section 1100 and placing blank 10 on deck 1310. More specifically, in the example embodiment, actuator 1208 is controlled, commanded, and/or instructed to rotate drive shaft 1212 in a first direction (clockwise in the view of FIG. 6). As arms 1204 rotate with drive shaft 1212, guide rods 1224 and pivot blocks 1225 cooperate to orient pick-up bar 1216 such that suction cups 1220 are positioned in sealing contact with blank 10, which is presented generally perpendicular to blank loading direction X in feed section 1100. Actuator 1208 is then controlled, commanded, and/or instructed to rotate drive shaft 1212 in a second, opposite direction (counterclockwise in the view of FIG. 6). As arms 1204 rotate with drive shaft 1212, activated suction cups 1220 extract blank 10 from feed section 1100. Moreover, guide rods 1224 and pivot blocks 1225 cooperate to rotate pick-up bar 1216 such that blank 10 is oriented generally perpendicular to vertical direction Z as pick-up bar 1216 approaches deck 1310. Finally, vacuum pressure through suction cups 1220 is controlled, commanded, and/or instructed to be de-activated, depositing blank 10 on deck 1310 such that leading edge 126 and first free edge 56 are aligned at substantially the predetermined location along deck 1310 with respect to the X and Y direction, respectively, and interior surface 12 is facing upward. In certain embodiments, actuator 1208 is then controlled, commanded, and/or instructed to rotate drive shaft 1212 in the first direction to provide clearance for other operations of machine 1000 proximate deck 1310. For example, first blank transfer assembly 1202 is rotated to extract another blank 10 and/or to pause in a neutral position to provide clearance for other operations of machine 1000 proximate deck 1310, as will be described herein. In alternative embodiments, first blank transfer assembly 1202 is operated in any suitable additional or alternative fashion that enable first blank transfer assembly 1202 to function as described herein.

Figure 7:
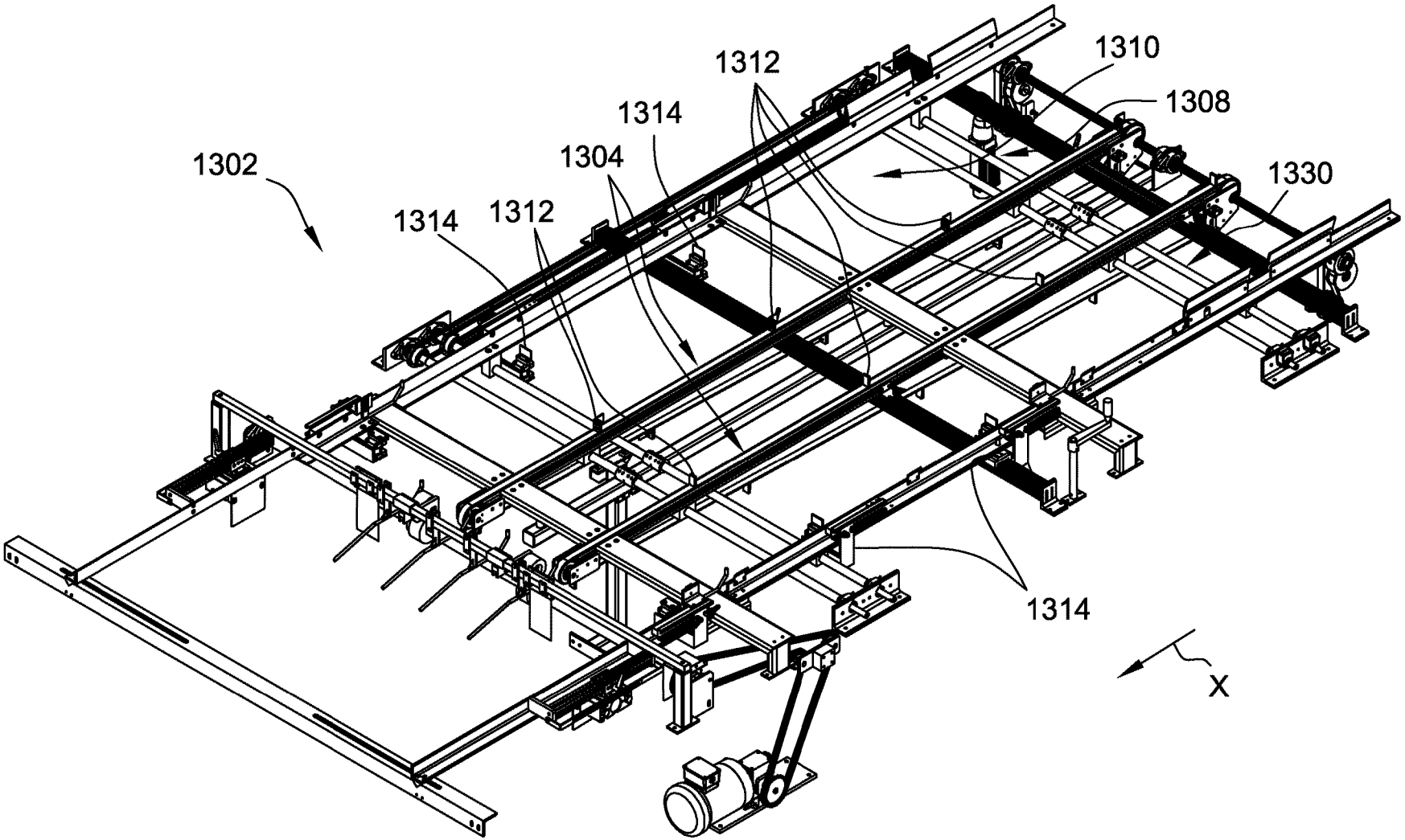
FIG. 7 is a perspective view of an example forwarding assembly of an indexing section of the machine shown in FIGS. 4 and 5.

FIG. 7 is a schematic perspective view of an example embodiment of a portion of a forwarding assembly 1302 operably coupled to an actuator 1308 for bi-directional translation parallel to the X direction through indexing section 1300 of machine 1000. For example, actuator 1308 includes at least one of a hydraulic jack, an air cylinder, a mechanical linkage, a servomechanism, and another suitable mechanical or electronic actuator. First blank transfer assembly 1202 is configured to position blanks 10 proximate first end 1330 of deck 1310. Deck 1310 is configured to support blanks 10 in a generally horizontal position (i.e., generally parallel to the X-Y plane) in indexing section 1300 as webs 16 are coupled to blanks 10, as described further herein.

In the example embodiment, forwarding assembly 1302 includes a pair of feed chains 1304 with lugs 1312 extending therefrom. Lugs 1312 are spaced apart along feed chains 1304, to advance blanks 10 along deck 1310 and to maintain the desired amount of space between adjacent blanks 10. In one embodiment, lug spacing is dependent on a size of blank 10 and, in an alternative embodiment, lugs 1312 are at a predetermined spacing and a size of blank 10 is entered into control system 1004. Lugs 1312 are configured to move blanks 10 and blank assemblies 130 through indexing section 1300 such that lugs 1312 are generally downstream from trailing edge 128 of blanks 10. Specifically, to advance blanks 10 along deck 1310, actuator 1308 coupled to chains 1304 is actuated (e.g., by a control signal from control system 1004) to control chains 1304. Chains 1304 are advanced, and lugs 1312 contact trailing edge 128 of blank 10. In the example embodiment, there are two chains 1304, each with one lug 1312 contacting trailing edge 128 of blank 10 such that two lugs 1312 are contacting trailing edge 128 of blank 10. In other embodiments, there are three or more chains 1304, each with one or more lugs 1312 contacting trailing edge 128 of blank 10 such that three or more lugs 1312 are contacting trailing edge 128 of blank 10.

Forwarding assembly 1302 further includes a plurality of stoppers 1314. Stoppers 1314 are configured to be activated to stop blanks 10 in active assembly zones 2002 and 2006 (shown in FIG. 11), described in detail below. Specifically, stoppers 1314 are controlled using control system 1004 to activate or translate upwards in response to a precisely timed control signal. Lugs 1312 advance blank 10 into contact with stoppers 1314. As such, stoppers 1314 precisely align blanks 10 on deck 1310 for web transfer assemblies 1708 and 1710 (shown in FIGS. 8 and 9) to couple webs 16 to blanks 10, as described in detail below. Stoppers 1314 are subsequently controlled to translate downwards in response to a precisely timed control signal to permit blanks 10 and/or blank assemblies 130 to be advanced through indexing section 1300 using lugs 1312, as described above.

Figure 8:
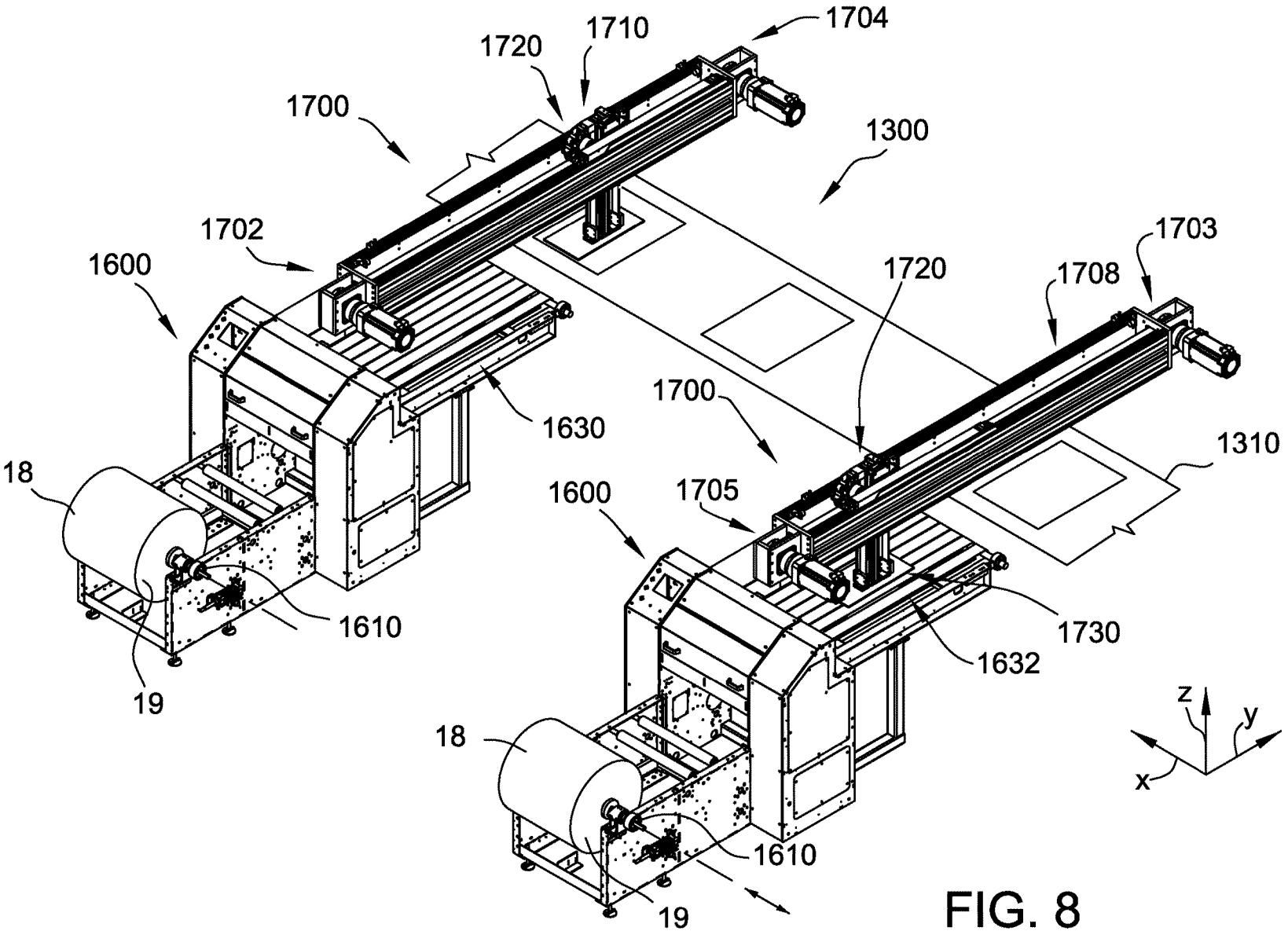
FIG. 8 is a perspective view of example web separators and example web transfer sections for use with the machine shown in FIGS. 4 and 5 in first, operationally offset positions.
Figure 9:
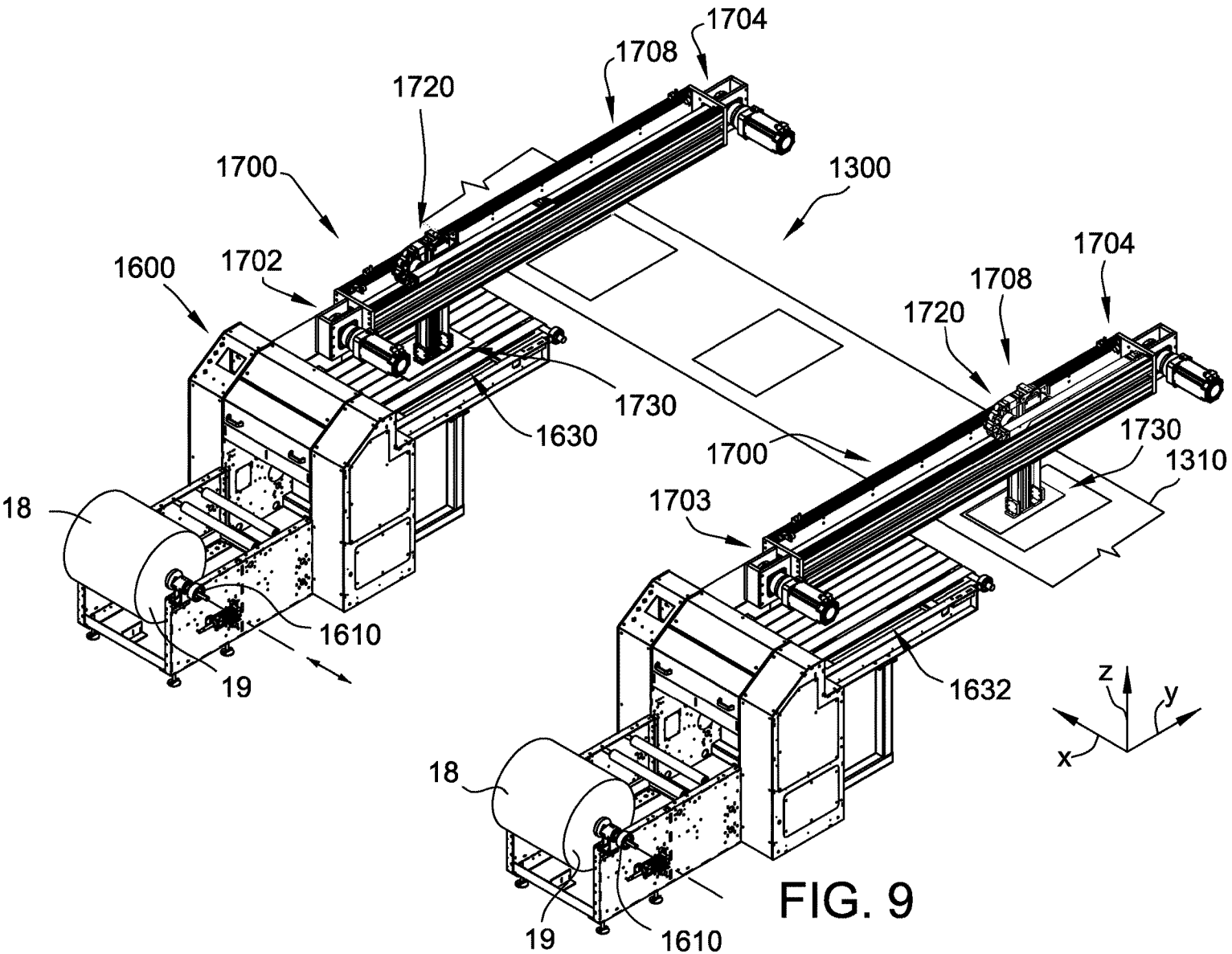
FIG. 9 is a perspective view of the example web separators and example web transfer sections shown in FIG. 8 in second, operationally offset positions.

FIGS. 8 and 9 are schematic perspective views of web separator 1600 and web transfer section 1700 suitable for use with machine 1000. In the example embodiment, there are two web separators 1600 and web transfer assemblies 1708 and 1710 that perform in the same manner. In the example embodiment, each web separator 1600 is operable to cut sheets of predetermined length $L_2$, as shown in FIG. 2, from a roll 18 of web material to form webs 16 (shown in FIG. 2), and to deposit each web 16 sequentially on a generally horizontal respective first platform 1630 or second platform 1632 for pick-up in web transfer section 1700. For example, web separator 1600 may include a sheeter machine, such as Rosenthal® sheeter manufactured by Rosenthal Manufacturing Co., Inc., 1840 Janke Drive, Northbrook Ill. 60062. In alternative embodiments, web separator 1600 is any other suitable mechanism for cutting roll 18 of web material into webs 16 of predetermined length $L_2$.

In certain embodiments, roll 18 of web material includes rolled web material coated on both sides with a cohesive material, as well as a backing material (not shown) configured to prevent the cohesive material from adhering to itself between adjacent layers of the rolled web material. In such embodiments, web separator 1600 is suitably operable to remove the backing material prior to depositing each web 16 on first platform 1630 or second platform 1632. In alternative embodiments, roll 18 of web material does not include a backing material. For example, roll 18 of web material includes rolled web material coated on only one side with a cohesive material, such that a potential for the cohesive material to adhere to itself between adjacent layers of the rolled web material is reduced or eliminated. In the example embodiment, the cohesive material is on the back side of web 16, which facilitates keeping web 16 in place on first platform 1630 and second platform 1632 when web 16 is dispensed from web separator 1600 onto first platform 1630 or second platform 1632.

In the example embodiment, a spool receiver 1610 of web separator 1600 is slidably adjustable in a direction generally parallel to the X direction to facilitate overlapping bottom free edge 19 of web 16 with bottom side panels 62 and 68 and bottom end panels 96 and 102 of blank 10, as illustrated in FIG. 3, when web 16 is transferred to indexing section 1300. In alternative embodiments, at least one of web separator 1600 and web transfer section 1700 includes suitable additional or alternative structure to facilitate overlapping bottom free edge 19 of web 16 with bottom side panels 62 and 68 and bottom end panels 96 and 102 of blank 10.

Web transfer section 1700 includes first web transfer assembly 1710 and second web transfer assembly 1708. Each web transfer assembly 1708, 1710 is configured to pick up a cut sheet of web material, constituting web 16, from a respective platform 1630 and 1632 and deposit web 16 in an at least partially overlying relationship with a blank 10 positioned on deck 1310.

In the example embodiment, first web transfer assembly 1710 extends generally in transverse direction Y from a first end 1702 to an opposite second end 1704. More specifically, first end 1702 is proximate first platform 1630, and second end 1704 is positioned over indexing section 1300, with respect to vertical direction Z, and proximate deck 1310. Second web transfer assembly 1708 extends generally in transverse direction Y from a third end 1703 (i.e., a first end 1703 of second web transfer assembly 1708) to a fourth end 1705 (i.e., a second end 1705 of second web transfer assembly 1708). Second web transfer assembly 1708 is positioned upstream from first web transfer assembly 1710 of machine 1000 (shown in FIGS. 4 and 5) with respect to blank loading direction X. Third end 1703 is positioned downstream from first end 1702, and fourth end 1705 is positioned downstream from second end 1704, both with respect to blank loading direction X. Third end 1703 is proximate second platform 1632, and fourth end is positioned over indexing section 1300, with respect to vertical direction Z, and proximate deck 1310. First web transfer assembly 1710 and second web transfer assembly 1708 operate in substantially the same way except that first web transfer assembly 1710 and second web transfer assembly 1708 are operationally offset from one another, as shown in FIGS. 8 and 9 and as described in detail below with regard to FIGS. 13A-13E.

First web transfer assembly 1710 includes a gantry 1720 operable for bi-directional translation between first end 1702 and second end 1704. Second web transfer assembly 1708 also includes a gantry 1720 operable for bi-directional translation between third end 1703 and fourth end 1705. In the example embodiment, a pick-up assembly 1730 is coupled to gantry 1720 for bi-directional translation with respect to gantry 1720 generally parallel to the vertical Z direction. Pick-up assembly 1730 is operable to (i) pick web 16 from first platform 1630 when gantry 1720 is positioned proximate first end 1702, (ii) transport web 16 from proximate first end 1702 to proximate second end 1704, and (iii) deposit web 16 in the at least partially overlying relationship with blank 10 positioned on deck 1310 when gantry 1720 is positioned proximate second end 1704. Second web transfer assembly 1708 includes the same elements and functions in an equivalent manner.

Figure 10:
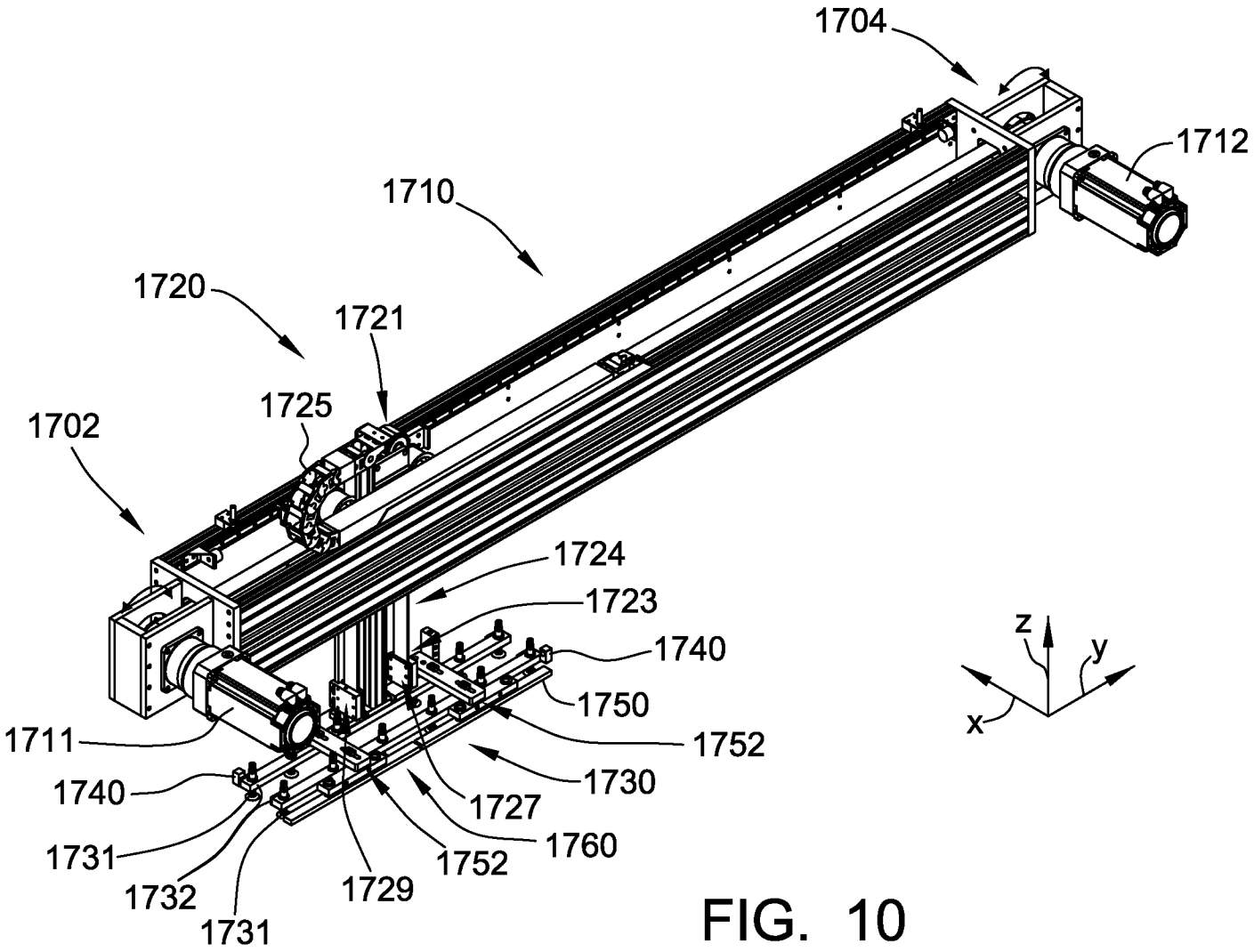
FIG. 10 is a perspective view of an example web transfer mechanism for use with the web transfer sections shown in FIGS. 8 and 9.

FIG. 10 is a schematic perspective view of an example embodiment of first web transfer assembly 1710. First web transfer assembly includes a lift arm 1724 coupled to gantry 1720 for bi-directional translation relative to gantry 1720 in the Z direction. Lift arm 1724 extends generally in the Z direction from a first end 1721 to a second end 1723, and pick-up assembly 1730 is coupled to lift arm second end 1723. In addition, a first servomechanism 1711 operable for bi-directional rotation is coupled proximate first end 1702 of web transfer assembly 1710, and a second servomechanism 1712 operable for bi-directional rotation is coupled proximate second end 1704 of web transfer assembly 1710. Each servomechanism 1711 and 1712 is coupled in driving relationship with an open loop belt 1725 that extends from a first end 1727 to a second end 1729. Each of belt first end 1727 and belt second end 1729 is coupled to lift arm 1724 proximate second end 1723.

Belt 1725 is looped in a circuit, in a counterclockwise direction in the view of FIG. 8, from second end 1723 of lift arm 1724 adjacent pick-up assembly 1730, around second servomechanism 1712, around first end 1721 of lift arm 1724, around first servomechanism 1711, and back to second end 1723 of lift arm 1724, such that lift arm 1724 is carried by belt 1725. Thus, when each servomechanism 1711 and 1712 rotates in a first direction (counterclockwise in the view of FIG. 10) at a substantially identical speed, gantry 1720 translates in the Y direction with respect to transfer assembly 1710 and lift arm 1724 does not substantially translate with respect to gantry 1720; when each servomechanism 1711 and 1712 rotates in a second direction (clockwise in the view of FIG. 10) opposite the first direction at a substantially identical speed, gantry 1720 translates opposite the Y direction with respect to transfer assembly 1710 and lift arm 1724 does not substantially translate with respect to gantry 1720; when first servomechanism 1711 rotates in the second direction and second servomechanism 1712 rotates in the first direction at a substantially identical speed, gantry 1720 does not substantially translate with respect to transfer assembly 1710 and lift arm 1724 (and, hence, pick-up assembly 1730) translates with respect to gantry 1720 in the Z direction; and when first servomechanism 1711 rotates in the first direction and second servomechanism 1712 rotates in the second direction at a substantially identical speed, gantry 1720 does not substantially translate with respect to transfer assembly 1710 and lift arm 1724 (and, hence, pick-up assembly 1730) translates with respect to gantry 1720 opposite the Z direction. In alternative embodiments, web transfer assembly 1710 includes any suitable additional or alternative structure that enables web transfer section 1700 to function as described herein. For example, web transfer assembly 1710 may be a dual axis gear rack system. An example of another web transfer assembly 1710 is described in U.S. patent application Ser. No. 15/949,958 filed Apr. 10, 2018, entitled "Machine and Methods for Attaching a Tray Blank to a Cover Blank," which is hereby incorporated by reference herein.

In the example embodiment, servomechanisms 1711 and 1712 are matched and geared electronically to facilitate operation at identical rotational speed, acceleration, and deceleration. For purposes of this disclosure, the operation of servomechanisms 1711 and 1712 at substantially identical speeds includes operation of servomechanisms 1711 and 1712 with a slight variance in angular speed, acceleration, and/or deceleration to facilitate slightly curvilinear motion of pick-up assembly 1730 relative to frame 1002 to, for example, facilitate a smooth transition from Y-direction translation to Z-direction translation, and vice versa, of pick-up assembly 1730 relative to frame 1002.

A plurality of vacuum suction cups 1731 are coupled to pick-up assembly 1730. In the example embodiment, each suction cup 1731 is coupled to pick-up assembly 1730 via a respective spring 1732 having a first stiffness and configured for compression in the Z direction. In alternative embodiments, each suction cup 1731 is coupled to pick-up assembly 1730 substantially rigidly with respect to the Z direction. Each suction cup 1731 is operably coupled to a respective independent vacuum generator (not shown) for selectively providing suction to selectively attach suction cups 1731 to web 16 presented on first platform 1630. In alternative embodiments, at least some suction cups 1731 are coupled to a common vacuum generator.

In the example embodiment, a compression member 1750 is coupled to pick-up assembly 1730 via at least one spring 1752. Each compression member spring 1752 is configured for compression in the Z direction. Compression member 1750 is configured to compress at least a portion of coupling region 29 of web 16 against blank 10 positioned on deck 1310 when pick-up assembly 1730 deposits web 16, to facilitate bonding web 16 to blank 10. Specifically, a compression surface 1760 of compression member 1750 is configured to be positioned proximate blank 10 when blank 10 is positioned on deck 1310. In the example embodiment, compression surface 1760 has sufficient depth in the X direction and sufficient width in the Y direction to provide a compression surface against substantially all of coupling region 29 of blank 10 that is adhered to web 16 to form blank assembly 130. In alternative embodiments, compression surface 1760 has sufficient depth in the X direction and sufficient width in the Y direction to provide a compression surface against less than substantially all of coupling region 29 of blank 10 that is adhered to web 16 to form blank assembly 130. Moreover, in some embodiments, each compression member spring 1752 has a second stiffness that is greater than the first stiffness of suction cup springs 1732, to facilitate application of greater force by compression member 1750 on web 16 and blank 10, relative to a force applied by suction cups 1731 on web 16 and blank 10. In alternative embodiments, each compression member spring 1752 and suction cup spring 1732 has any suitable stiffness that enables pick-up assembly 1730 to function as described herein.

In alternative embodiments, pick-up assembly 1730 does not include compression member 1750. For example, adhesive is applied to at least a portion of coupling region 29 of web 16, web 16 is positioned in the at least partially overlying relationship with blank 10, and coupling region 29 of web 16 and blank 10 are securely bonded together without additional compression of coupling region 29 against blank 10.

Also in the example embodiment, pick-up assembly 1730 includes a respective sensor 1740 disposed at opposing (with respect to the Y direction) ends of pick-up assembly 1730 to verify that web 16 is successfully picked up and coupled to suction cups 1731 as gantry 1720 is moved from proximate first end 1702 to proximate second end 1704. For example, each sensor 1740 is a photo eye operable to detect a presence or absence of web 16 directly beneath pick-up assembly 1730. For example, as a speed of transfer of webs 16 by web transfer assemblies 1710, 1708 is increased to facilitate increasing output of blank assemblies 130 by machine 1000, a potential for an occasional premature de-coupling of web 16 from pick-up assembly 1730 may arise. Sensors 1740 facilitate detecting this condition and diverting a resulting blank assembly 130 formed without web 16 from outfeed section 1400 or product loading section 1500 (shown in FIG. 5). In alternative embodiments, machine 1000 includes suitable additional or alternative mechanisms for detecting premature de-coupling of web 16 from pick-up assembly 1730. In the example embodiment, additional photo eye sensors (not specifically shown) are coupled to frame 1002 of machine 1000 (shown in FIGS. 4 and 5). These photo eye sensors are positioned on the frame such that the photo eye sensors can detect if blank 10 or web 16 falls to the ground below machine 1000.

In some embodiments, a round trip cycle by web transfer assembly 1710, from picking up web 16 from first platform 1630 proximate first end 1702, to depositing web 16 at deck 1310 proximate second end 1704, and back again to proximate first end 1702, is approximately 1 second or less. In alternative embodiments, the round trip transit time is greater than approximately 1 second but less than 5 seconds. In the current embodiment, first and second web transfer assemblies 1710 and 1708 together can form 40 to 60 blank assemblies per minute.

Figure 11:
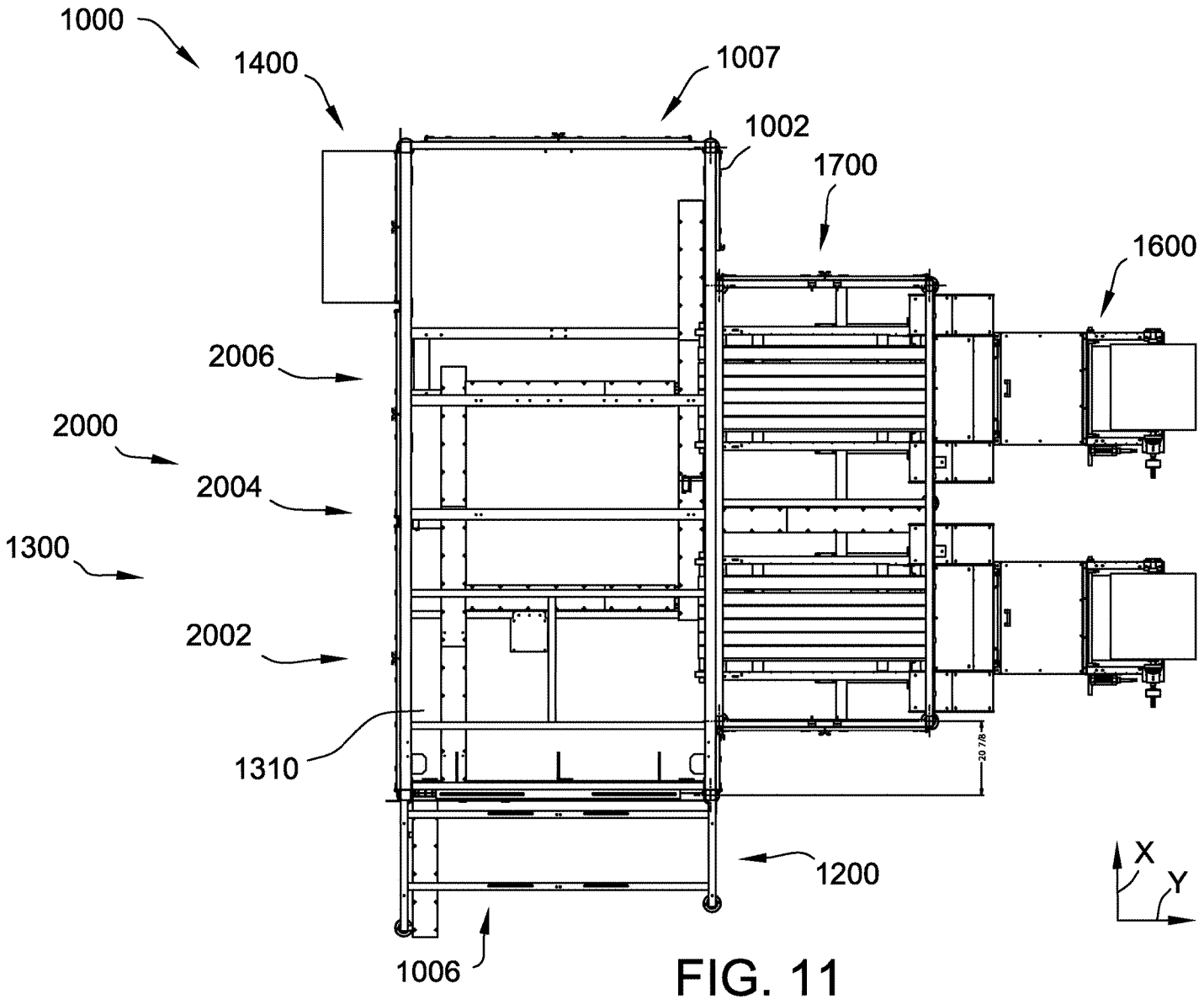
FIG. 11 is a top view of the machine shown in FIGS. 4 and 5.

FIG. 11 is a top view of machine 1000 (shown in FIGS. 4 and 5), specifically of indexing section 1300 of machine 1000. Indexing section 1300 includes a plurality of indexing zones 2000 aligned in series along blank transfer direction X. In particular, indexing zones 2000 include, in series, a first "active" indexing zone 2002, a first "idle" indexing zone 2004, and a second active indexing zone 2006. First and second active indexing zones 2002 and 2006 are also referred to as "assembly zones" 2002, 2006. First assembly zone 2002 and second assembly zone 2006 relate to the areas on deck 1310 were first and second web transfer assemblies 1710 and 1708 deposit respective webs onto respective blanks that are on deck 1310. Second end 1704 (shown in FIG. 8) of first web transfer assembly 1710 is generally above first assembly zone 2002. Fourth end 1705 (shown in FIG. 8) of second web transfer assembly 1708 is generally above second assembly zone 2006. Idle indexing zone 2004 is the area between first assembly zone 2002 and second assembly zone 2006.

First assembly zone 2002 is downstream from blank transfer section 1200 with respect to blank loading direction X. Idle indexing zone 2004 is downstream from first assembly zone 2002 with respect to direction X, and second assembly zone 2006 is downstream from idle indexing zone 2004 with respect to direction X. That is, once blanks, like blank 10 (shown in FIG. 1), are on deck 1310, the blanks move from first assembly zone 2002 to idle indexing zone 2004 to second assembly zone 2006. After the blanks move through second assembly zone 2006, they are advanced into outfeed section 1400.

Figure 12:
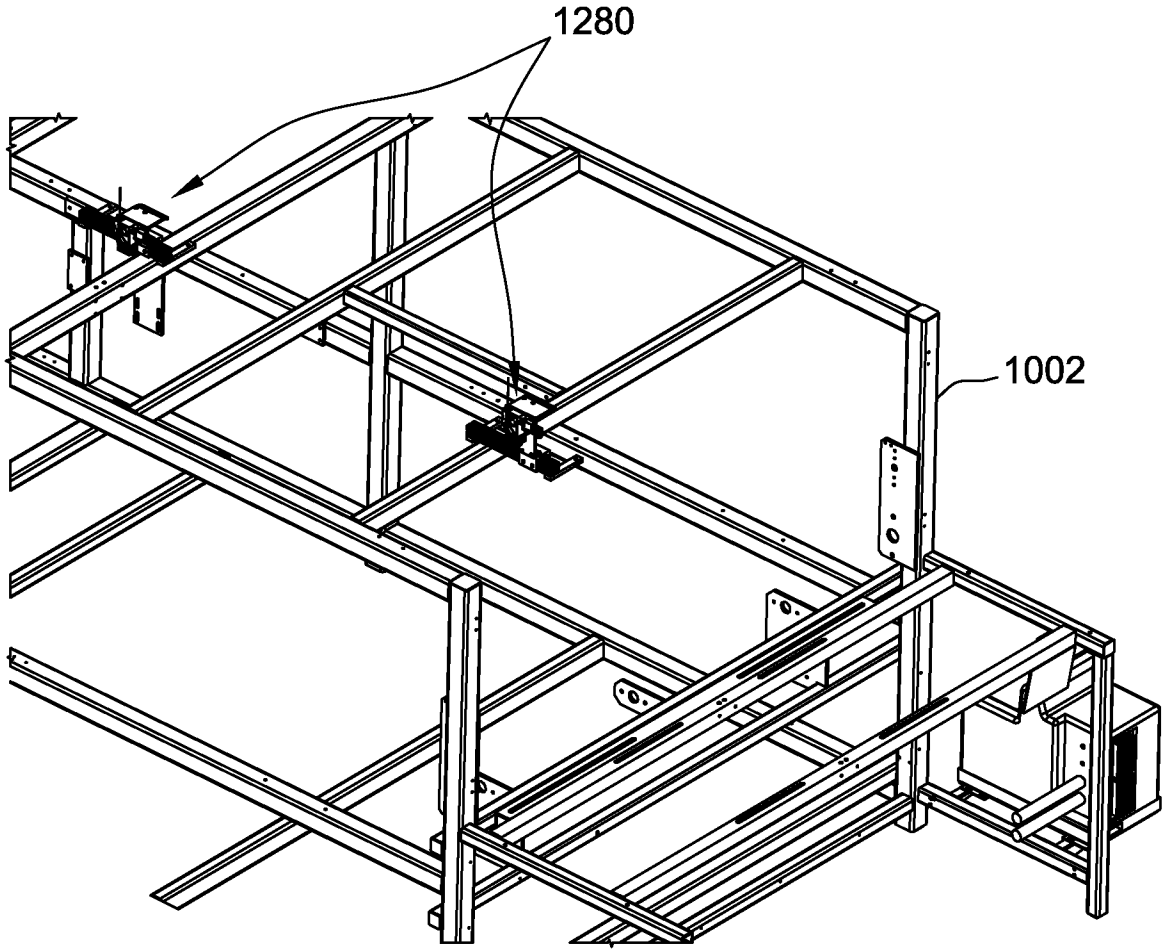
FIG. 12 is a perspective view of an example embodiment of a glue assembly of the machine shown in FIGS. 4 and 5.

FIG. 12 is a perspective view of a web adhesive applicator 1280 coupled to frame 1002 of machine 1000 (shown in FIGS. 4 and 5). With reference to FIGS. 6, 8, 9, and 11, in the example embodiment, web adhesive applicator 1280 is fixedly coupled to frame 1002 proximate an interface between web transfer section 1700 and indexing section 1300 for both first web transfer assembly 1710 and second web transfer assembly 1708. More specifically, web adhesive applicators 1280 are located in a position such that web adhesive applicators 1280 are aligned with first and second active assembly zones 2002 and 2006. In the example embodiment, web adhesive applicators 1280 are offset upstream, with respect to the X direction, from leading edge 126 of blank 10 such that adhesive is applied to web 16 in the region thereof that overlaps blank 10. In alternative embodiments, web adhesive applicator 1280 is associated with and/or positioned with respect to frame 1002 in any suitable fashion that enables web adhesive applicator 1280 to function as described herein.

In the example embodiment, web adhesive applicator 1280 is operable to eject an adhesive material upwardly, generally parallel to the Z direction, as web 16 is translated above web adhesive applicators 1280 along the Y direction by web transfer assemblies 1708 and 1710, such that the adhesive is applied to at least a portion of coupling region 29 of bottom surface 27 of web 16, for webs 16 carried by of each web transfer assembly 1708 and 1710. For example, the timing of operation of web adhesive applicators 1280 is controllable by control system 1004 such that the adhesive is precisely applied as a web 16 is passing over web adhesive applicator 1280, just prior to be deposited onto a blank 10. In alternative embodiments, adhesive is applied to coupling region 29, and/or to a portion of interior surface 12 of blank 10 complementary to coupling region 29, from any suitable direction in any suitable fashion.

Machine 1000 is generally configured to operate as follows, with reference to FIGS. 1-12, and only describing first web transfer assembly 1710 for ease of description, knowing that first web transfer assembly 1710 and second web transfer assembly 1708 operate in essentially the same way. In operation, first blank transfer assembly 1202 positions blanks 10 onto first end 1330 of deck 1310, such that blanks 10 are positioned in indexing section 1300. Actuator 1308 is controlled, commanded, and/or instructed to translate lugs 1312 in the X direction of indexing section 1300 to move blanks 10 along blank indexing section 1300. Further, actuator 1308 is controlled, commanded, and/or instructed to translate lugs 1312 in the X direction to a second position, in which lugs 1312 are positioned out of a path traveled by forwarding assembly 1302 as it transfer the formed blank assembly 130 to outfeed section 1400. Web separator 1600 cuts web 16 from roll 18 of web material and positions web 16 on first platform 1630.

Servomechanisms 1711 and 1712 are controlled, commanded, and/or instructed to rotate simultaneously in the clockwise direction (in the view of FIG. 10) to translate gantry 1720 opposite the Y direction to proximate first end 1702 of web transfer assembly 1710. With gantry 1720 proximate first end 1702, first servomechanism 1711 is controlled, commanded, and/or instructed to rotate in the counterclockwise direction and second servomechanism 1712 is controlled, commanded, and/or instructed to rotate simultaneously in the clockwise direction to translate lift arm 1724 opposite the Z direction, such that pick-up assembly 1730 is positioned in close proximity to web 16 positioned on first platform 1630. Suction cups 1731 are controlled, commanded, and/or instructed to activate, coupling web 16 to pick-up assembly 1730. First servomechanism 1711 is controlled, commanded, and/or instructed to rotate in the clockwise direction and second servomechanism 1712 is controlled, commanded, and/or instructed to rotate simultaneously in the counterclockwise direction (in the view of FIG. 10) to translate lift arm 1724 in the Z direction, such that pick-up assembly 1730 lifts web 16 off of first platform 1630.

Further in operation, servomechanisms 1711 and 1712 are controlled, commanded, and/or instructed to rotate simultaneously in the counterclockwise direction (in the view of FIG. 10) to translate gantry 1720 in the Y direction to carry web 16 towards second end 1704 of web transfer assembly 1710. In certain embodiments, as gantry 1720 is translated towards second end 1704, sensors 1740 transmit a signal to control system 1004 to indicate whether web 16 remains coupled to pick-up assembly 1730. Moreover, as gantry 1720 is translated towards second end 1704, web 16 passes over web adhesive applicator 1280. Web adhesive applicator 1280 is controlled, commanded, and/or instructed to apply adhesive to at least a portion of coupling region 29 of bottom surface 27 of web 16 as web 16 passes applicator 1280.

In the example embodiment, as gantry 1720 arrives proximate second end 1704, servomechanisms 1711 and 1712 are controlled, commanded, and/or instructed to position gantry 1720 with respect to the Y direction such that first side free edge 21 of web 16 is offset from first free edge 56 of blank 10 by the second predetermined offset distance $d_2$. In alternative embodiments, machine 1000 includes any suitable additional or alternative structure that facilitates positioning web 16 with respect to blank 10 with respect to the Y direction. Also in the example embodiment, bottom free edge 19 of web 16 is offset from leading edge 126 of blank 10 with respect to the X direction by the first predetermined offset distance $d_1$ due to the pre-adjustment of spool receiver 1610 of web separator 1600, as described above. In the example embodiment, first predetermined offset distance $d_1$ is one-fourth of an inch. In other embodiments, first predetermined offset distance $d_1$ may be any suitable distance. In alternative embodiments, machine 1000 includes any suitable additional or alternative structure that facilitates positioning web 16 with respect to blank 10 with respect to the X direction.

With gantry 1720 proximate second end 1704, first servomechanism 1711 is controlled, commanded, and/or instructed to rotate in the counterclockwise direction and second servomechanism 1712 is controlled, commanded, and/or instructed to rotate simultaneously in the clockwise direction to translate lift arm 1724 opposite the Z direction, such that pick-up assembly 1730 positions web 16 in close proximity to blank 10 positioned on deck 1310. In certain embodiments, pick-up assembly 1730 is moved opposite the Z direction to an extent such that compression member 1750 exerts a force opposite the Z direction on at least a portion of coupling region 29 of web 16 and the adjacent overlying portion of blank 10. Suction cups 1731 are controlled, commanded, and/or instructed to deactivate, releasing web 16 from pick-up assembly 1730.

Further in operation, first servomechanism 1711 is controlled, commanded, and/or instructed to rotate in the clockwise direction and second servomechanism 1712 is controlled, commanded, and/or instructed to rotate simultaneously in the counterclockwise direction (in the view of FIG. 10) to translate lift arm 1724 in the Z direction, to provide clearance between pick-up assembly 1730 and deck 1310 (and, subsequently, between pick-up assembly 1730 and first platform 1630). After the desired clearance is obtained, servomechanisms 1711 and 1712 are controlled, commanded, and/or instructed to rotate simultaneously in the clockwise direction (in the view of FIG. 10) to translate gantry 1720 opposite the Y direction to proximate first end 1702 of web transfer assembly 1710 to retrieve another web 16.

FIGS. 13A-13E are top views of a simplified process implemented using machine 1000 (shown in FIGS. 4 and 5). Specifically, FIGS. 13A-13E depict a simplified indexing section 1300 and web transfer section 1700 and illustrate the offset operation of first and second web transfer assemblies 1710 and 1708. The blanks described with respect to this simplified process are identical or substantially similar to blank 10 (shown in FIG. 1). Likewise, the webs described with respect to this simplified process are identical or substantially similar to web 16 (shown in FIG. 2), and the blank assemblies (i.e., blanks with webs coupled thereto) are identical or substantially similar to blank assembly 130 (shown in FIG. 3). The blanks are illustrated as squares and the webs coupled to the blanks are illustrated as labelled rectangles for ease of illustration. The web transfer assemblies are illustrated as rectangles with descriptive labeling indicating whether the web transfer assemblies are with a web (i.e., carrying a web), without a web, or are placing a web. Webs labelled with A1, A2, A3, etc., are deposited onto blanks by the first web transfer assembly 1710 (shown in FIG. 8). Webs labelled with B1, B2, B3, etc., are deposited by the second web transfer assembly 1708 (shown in FIG. 8).

FIG. 13A shows a first step 2008 of the simplified process implemented using machine 1000. A first blank assembly 2021 is positioned in second assembly zone 2006, a second blank 2022 is positioned in idle indexing zone 2004, and a second blank assembly 2025 is positioned in first assembly zone 2002. First blank assembly 2021 includes a retaining web A1 that was deposited on and coupled to first blank 2020 by first web transfer assembly 1708 in a prior step. Second blank 2022 is in idle indexing zone 2004. Second blank assembly 2025 was just formed from a retaining web A2 deposited on and coupled to a third blank 2024 in the first assembly zone 2002. Immediately thereafter, as indicated by the directional arrow adjacent thereto, first web transfer assembly 1710 is moving away from first assembly zone 2002 (i.e., towards first end 1702 thereof) to web transfer section 1700 (shown in FIG. 11) to pick up another web. Simultaneously, as indicated by the directional arrow adjacent thereto, second web transfer assembly 1708 is moving toward second web transfer zone 2006 (i.e., towards fourth end 1705 thereof) with a web carried thereby.

FIG. 13B shows a second step 2010 of the simplified process. First blank assembly 2021 has been indexed into outfeed section 1400. Second blank 2022 has been indexed into second assembly zone 2006 and is positioned to receive a web B1 (shown in FIG. 13C) from second web transfer assembly 1708. Second blank assembly 2025 has been indexed into idle indexing zone 2004. A fourth blank 2026 has been transferred into first assembly zone 2002. First web transfer assembly 1710 is moving into web transfer section 1700 to pick up a web A3 (see FIG. 13D). Second web transfer assembly 1708 is moving into second assembly zone 2006 to couple web B1 to second blank 2022.

Figure 13E:
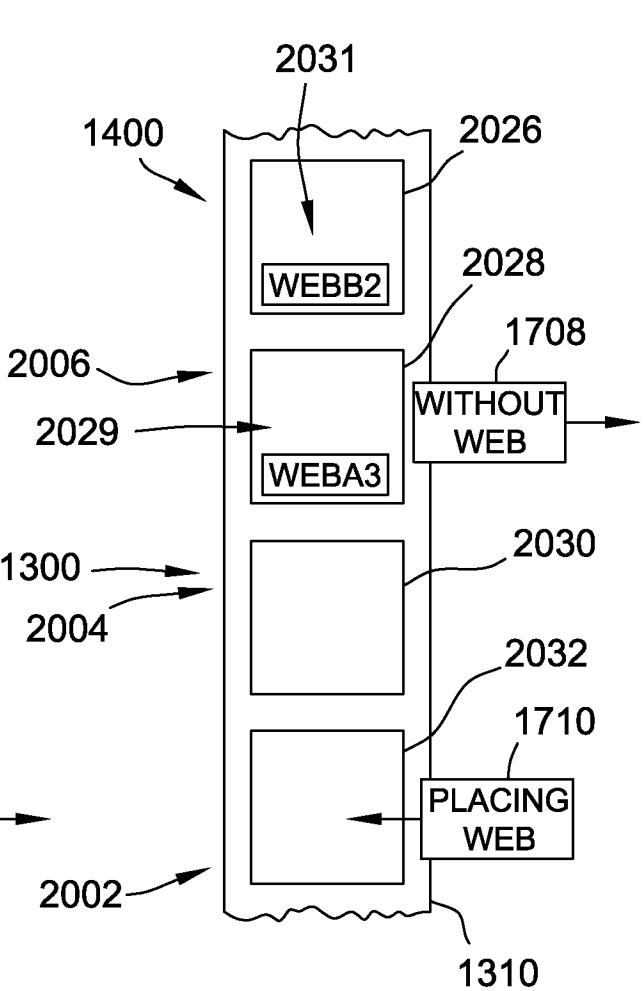

FIG. 13C shows a third step 2012 of the simplified process. Retaining web B1 has been deposited on and coupled to second blank 2022 by second web transfer assembly 1708, thereby forming a third blank assembly 2027. Third blank assembly 2027 was subsequently indexed into outfeed section 1400. Second blank assembly 2025 has been indexed into second assembly zone 2006. Fourth blank 2026 has been indexed into idle indexing zone 2004. A fifth blank 2028 has been transferred into first assembly zone 2002. First web transfer assembly 1710 is moving into first assembly zone 2002 to couple web A3 to fifth blank 2028. Second web transfer assembly 1708 is moving into web transfer section 1700 to pick up a web B2 (see FIG. 13E).

Figure 13D:
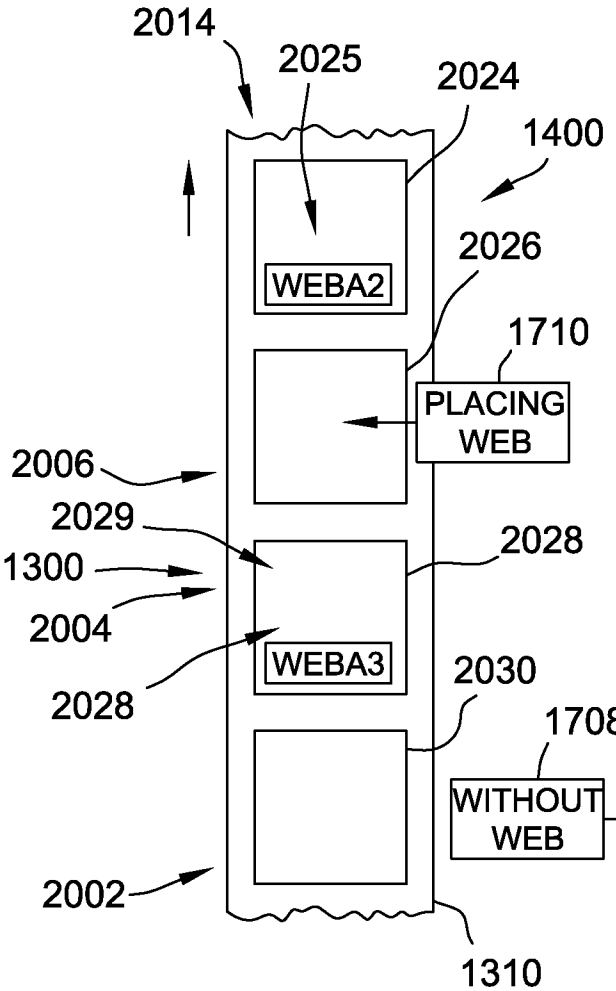

FIG. 13D shows a fourth step 2014 of the simplified process. Third blank assembly 2025 has been indexed into outfeed section 1400. Fourth blank 2026 has been indexed into second assembly zone 2006. Retaining web A3 has been deposited on and coupled to fifth blank 2028 by first web transfer assembly 1710, thereby forming a fourth blank assembly 2029. Fourth blank assembly 2029 has been indexed into idle indexing zone 2004. A sixth blank 2030 has been transferred into first assembly zone 2002. First web transfer assembly 1710 is moving toward web transfer section 1700 to retrieve a web A4, not specifically shown. Second web transfer assembly 1708 is moving into second assembly zone 2006 to couple web B2 to fourth blank 2026.

FIG. 13E shows a fifth step 2016 of the simplified process. Retaining web B2 has been deposited on and coupled to fourth blank 2026 by second web transfer assembly 1708, thereby forming a fifth blank assembly 2031. Fifth blank assembly 2031 was subsequently indexed into outfeed section 1400. Fourth blank assembly 2029 has been indexed into second assembly zone 2006. Sixth blank 2030 has been indexed into idle indexing zone 2004. A seventh blank 2032 has been transferred into first assembly zone 2002. First web transfer assembly 1710 is moving into first assembly zone 2002 to couple web A4, not specifically shown, to seventh blank 2032. Second web transfer assembly 1708 is moving into web transfer section 1700 to pick up a web B3, not specifically shown.

FIGS. 13A-13E show how first web transfer assembly 1710 and second web transfer assembly 1708 are operationally offset from one another. As used herein, "operationally offset" refers to the action of first and second web transfer assemblies 1710, 1708 being offset, staggered, or alternating in their respective operations. In one example, when first web transfer assembly 1710 is proximate first end 1702 thereof, second web transfer assembly 1708 is proximate fourth end 1705 thereof. In another example, when first web transfer assembly 1710 is picking up a web, second web transfer assembly 1708 is depositing a web onto a blank in second assembly zone 2006. Since first web transfer assembly 1710 and second web transfer assembly 1708 are operationally offset from one another, the amount of blank assemblies 130 that are made by machine 1000 increases. In the current embodiment, machine 1000 (shown in FIGS. 4 and 5) can produce 40 to 50 blank assemblies 130 per minute.

Figure 14:
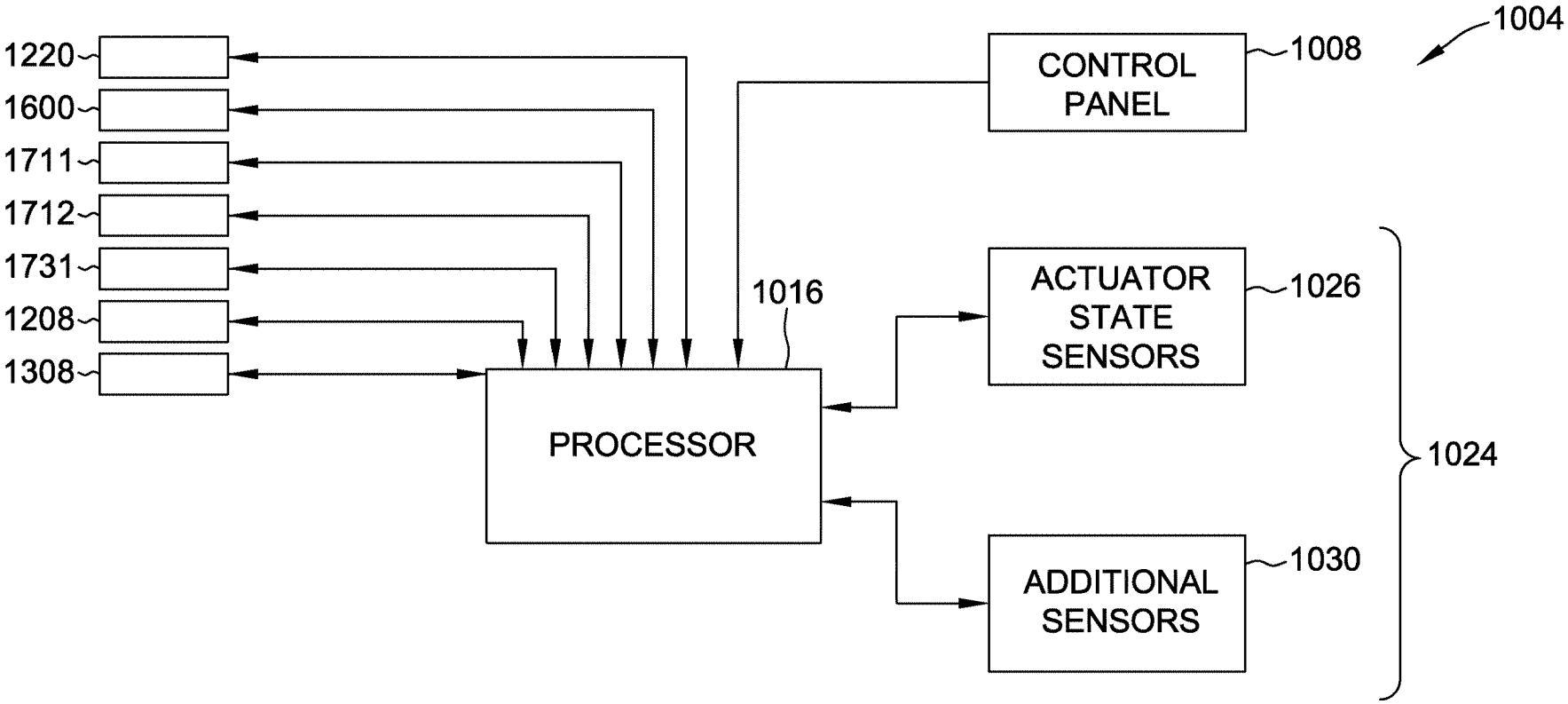
FIG. 14 is a block diagram of an example control system that may be used with the machine shown in FIGS. 4 and 5.

FIG. 14 is a schematic block diagram of control system 1004. In the example embodiment, control system 1004 includes at least one control panel 1008 and at least one processor 1016. In certain embodiments, reprogrammed recipes or protocols embodied on a non-transitory computer-readable medium are programmed in and/or uploaded into processor 1016 and such recipes include, but are not limited to, predetermined speed and timing profiles, wherein each profile is associated with forming blank assemblies from blanks and webs each having a predetermined size and shape.

In the example embodiment, one or more of actuators 1208 and 1308, web adhesive applicator 1280, web separator 1600, transfer mechanism servomechanisms 1711 and 1712, and suction cups 1220 and 1731 are integrated with machine control system 1004, such that control system 1004 is configured to transmit signals to each to control its operation. Moreover, a plurality of suitable sensors 1024 are disposed on machine 1000 and provide feedback to control system 1004 to enable machine 1000 to function as described herein. For example, plurality of sensors 1024 includes a first set 1026 of sensors to monitor a state of one or more of actuators 1208 and 1308, web adhesive applicator 1280, web separator 1600, transfer mechanism servomechanisms 1711 and 1712, and suction cups 1220 and 1731. For example, the state includes at least a position of a respective actuator. Plurality of sensors 1024 also includes a variety of additional sensors 1030, such as but not limited to sensors 1740, suitable for enabling control system 1004 and machine 1000 to operate as described herein.

In certain embodiments, control system 1004 is configured to facilitate selecting a speed and/or timing of the movement and/or activation of the devices and/or components associated with each of actuators 1208 and 1308, web adhesive applicator 1280, web separator 1600, transfer mechanism servomechanisms 1711 and 1712, and suction cups 1220 and 1731. The devices and/or components may be controlled either independently or as part of one or more linked mechanisms. For example, in embodiments where one or more of actuators 1208, 1308, 1711, and 1712 is a servomechanism, the speed and timing of each such actuator can be controlled independently as commanded by control system 1004.

In certain embodiments, control panel 1008 allows an operator to select a recipe that is appropriate for a particular blank assembly. The operator typically does not have sufficient access rights/capabilities to alter the recipes, although select users can be given privileges to create and/or edit recipes. Each recipe is a set of computer instructions that instruct machine 1000 as to forming the blank assembly. For example, machine 1000 is instructed as to speed and timing of picking a blank from feed section 1100, desired cut length $L_2$ of web 16 by web separator 1600, speed and timing of picking webs from web separator 1600 and transferring via web transfer section 1700, speed and timing of depositing and/or compressing the web on the blank to form the blank assembly, and speed and timing of transferring the formed blank assembly to outfeed section 1400. In embodiments where one or more actuators is a servomechanism, control system 1004 is able to control the movement of each such actuator independently relative to any other component of machine 1000. This enables an operator to maximize the number of blank assemblies that can be formed by machine 1000, easily change the size of blank assemblies being formed on machine 1000, and automatically change the type of blank assemblies being formed on machine 1000 while reducing or eliminating manually adjustments of machine 1000.

The example embodiments described herein provide a blank assembly-forming machine that advantageously facilitates formation of a blank assembly having an article-retaining web coupled to an interior of a blank. More specifically, the example embodiments described herein reduce or eliminate a need for additional packing material, such as packing peanuts, styrofoam popcorn, packing noodles, foam sheets, balled-up paper sheets, or some other cushioning material, to be placed inside the blank assembly when it is eventually formed into a container.

Example embodiments of methods and a machine for forming a blank assembly from a blank and a retaining web are described above in detail. The methods and machine are not limited to the specific embodiments described herein, but rather, components of systems and/or steps of the methods may be utilized independently and separately from other components and/or steps described herein. For example, the machine may also be used in combination with other blanks, and is not limited to practice with only the blank described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A machine for forming a blank assembly including a first blank and a first retaining web coupled to the first blank and a second blank and a second retaining web coupled to the second blank, said machine comprising:

a deck coupled to a frame, wherein the first and second blanks are positioned on the deck and spaced from one another in a blank transfer direction;

a first web transfer assembly extending from a first end to a second end, said first web transfer assembly comprising a first pick-up assembly moveable between said first end and said second end, said first pick-up assembly configured to pick up the first retaining web proximate said first end and deposit the first web proximate said second end in an at least partially overlying relationship with the first blank positioned on said deck; and a second web transfer assembly extending from a third end to a fourth end, said second web transfer assembly comprising a second pick-up assembly moveable between said third end and said fourth end, said second pick-up assembly configured to pick up the second retaining web proximate said third end and deposit the second web proximate said fourth end in an at least partially overlying relationship with the second blank positioned on said deck, said second web transfer assembly spaced from said first web transfer assembly in the blank transfer direction, wherein said first web transfer assembly and said second web transfer assembly are operationally offset in an alternating manner when transferring the first retaining web and transferring the second retaining web.

2. The machine in accordance with claim 1, wherein said first web transfer assembly and said second web transfer assembly are operationally offset in an alternating manner such that said first web transfer assembly is proximate said first end and proximate picking up the first retaining web when said second web transfer assembly is proximate said fourth end and proximate depositing the second retaining web.

3. The machine in accordance with claim 2, wherein said first web transfer assembly and said second web transfer assembly are operationally offset in an alternating manner from one another such that said first web transfer assembly deposits the first retaining web on the first blank as said second web transfer assembly picks up the second retaining web.

4. The machine in accordance with claim 1, wherein said deck extends in the blank transfer direction from a first deck end to a second deck end.

5. The machine in accordance with claim 4, further comprising:

a blank transfer assembly configured to transfer the first and second blanks onto said deck in series at said first deck end; and a forwarding assembly configured to advance the first and second blanks in the blank transfer direction.

6. The machine in accordance with claim 5, further comprising:

a first plurality of stoppers downstream of a first position in the blank transfer direction;

a second plurality of stoppers downstream of a second position in the blank transfer direction; and a plurality of lugs configured to advance the first blank to the first position wherein a leading edge of the first blank is engaged with said first plurality of stoppers and to advance the second blank to the second position wherein a leading edge of the second blank is engaged with said second plurality of stoppers.

7. The machine in accordance with claim 5, wherein said first pick-up assembly is configured to move the first retaining web from proximate said first end of said first web transfer assembly to proximate said second end of said first web transfer assembly, and said second pick-up assembly is configured to move the second retaining web from proximate said third end of said second web transfer assembly to proximate said fourth end of said second web transfer assembly in a transfer direction that is generally perpendicular to the blank transfer direction.

8. The machine in accordance with claim 7, further comprising:

a first adhesive applicator configured to activate to apply adhesive to the first retaining web as said first web transfer assembly moves the first retaining web from said first end to said second end of said first web transfer assembly; and a second adhesive applicator configured to activate to apply adhesive to the second retaining web as said second web transfer assembly moves the second retaining web from said third end to said fourth end of said second web transfer assembly.

9. The machine in accordance with claim 4, wherein said deck comprises a first assembly zone located at said first deck end, a second assembly zone located at said second deck end, and an idle indexing zone located between said first assembly zone and said second assembly zone.

10. The machine in accordance with claim 9, wherein said first web transfer assembly deposits the first web in the at least partially overlying relationship with the first blank proximate said first assembly zone, and wherein said second transfer assembly deposits the second web in the at least partially overlying relationship with the second blank proximate the second assembly zone.

11. The machine in accordance with claim 1, further comprising a web unrolling assembly configured to:

unroll web material;

pull the web material taught;

cut the web material at a predetermined length to form at least the first retaining web; and position the first retaining web on a conveyor to be picked up by said first web transfer assembly.

12. The machine in accordance with claim 1, wherein said first web transfer assembly has a first sensor coupled to said first web transfer assembly configured to monitor placement of said first retaining web relative to said first web transfer assembly, and wherein said second web transfer assembly has a second sensor coupled to said second web transfer assembly configured to monitor placement of said second retaining web relative to said second web transfer assembly.

* * * * *